US010941935B2

(12) United States Patent
Sugihara et al.

(10) Patent No.: US 10,941,935 B2
(45) Date of Patent: Mar. 9, 2021

(54) EVAPORATION TYPE BURNER

(71) Applicant: Sango Co., Ltd., Miyoshi (JP)

(72) Inventors: Shinya Sugihara, Miyoshi (JP); Yoshihiro Tsuchiya, Miyoshi (JP)

(73) Assignee: SANGO CO., LTD., Miyoshi (JP)

( * ) Notice: Subject to any disclaimer, the term of this patent is extended or adjusted under 35 U.S.C. 154(b) by 125 days.

(21) Appl. No.: 16/349,026

(22) PCT Filed: Sep. 14, 2017

(86) PCT No.: PCT/JP2017/033274
§ 371 (c)(1),
(2) Date: May 10, 2019

(87) PCT Pub. No.: WO2018/100843
PCT Pub. Date: Jun. 7, 2018

(65) Prior Publication Data

US 2019/0264908 A1 Aug. 29, 2019

(30) Foreign Application Priority Data

Dec. 1, 2016 (JP) ..... 2016-234337

(51) Int. Cl.
*F23D 3/40* (2006.01)
*B01B 1/00* (2006.01)
(Continued)

(52) U.S. Cl.
CPC ..... *F23D 3/40* (2013.01); *B01B 1/005* (2013.01); *F23L 1/00* (2013.01); *F23Q 7/08* (2013.01)

(58) Field of Classification Search
CPC ... F23D 3/40; B01B 1/005; F23Q 7/08; F23L 9/02; F23L 1/00
See application file for complete search history.

(56) References Cited

U.S. PATENT DOCUMENTS 2,435,520 A * 2/1948 Vanderlaan ..... F21L 17/00 431/328
5,020,991 A 6/1991 Schaale et al.
(Continued)

FOREIGN PATENT DOCUMENTS

DE 102004057757 A1 6/2006
EP 1970624 A2 9/2008
(Continued)

OTHER PUBLICATIONS

International Preliminary Report on Patentability issued in corresponding International Patent Application No. PCT/JP2017/033274, 4 pages (dated Jan. 22, 2019).
(Continued)

*Primary Examiner* — Alfred Basichas
(74) *Attorney, Agent, or Firm* — Buchanan Ingersoll & Rooney PC

(57) ABSTRACT

An evaporation type burner which can attain light-up and stable combustion of fuel at an early stage by evenly distributing fuel supplied from a fuel supply part to an impregnation member (wick) inside the impregnation member should be provided includes an exudation prevention member having lower fuel permeability than that of the impregnation member in a surface region of the impregnation member opposite to a infiltration region, which is a surface region of the impregnation member where the fuel infiltrates from the fuel supply part into the impregnation member, across the impregnation member. Preferably, a part of the exudation prevention member is embedded inside of the impregnation member, and another part projects from a surface of the impregnation member. More preferably, the exudation prevention member is constituted as a part of the partition member disposed on a downstream side of the impregnation member in a combustion chamber.

9 Claims, 22 Drawing Sheets

(51) Int. Cl.
*F23Q 7/08* (2006.01)
*F23L 1/00* (2006.01)

(56) References Cited

U.S. PATENT DOCUMENTS

| | | | | |
|---|---|---|---|---|
| 5,056,501 | A * | 10/1991 | Ida | F23D 3/40 126/110 B |
| 5,197,871 | A * | 3/1993 | Yamamoto | F23D 3/40 126/110 B |
| 10,684,008 | B2 * | 6/2020 | Kido | F23Q 7/08 |
| 2001/0035463 | A1 | 11/2001 | Takagi et al. | |
| 2003/0027090 | A1 | 2/2003 | Blaschke et al. | |
| 2014/0234792 | A1 | 8/2014 | Brehmer et al. | |
| 2015/0102115 | A1 * | 4/2015 | Collmer | B60H 1/2212 237/12.3 C |
| 2015/0102116 | A1 | 4/2015 | Pfister et al. | |
| 2015/0102117 | A1 * | 4/2015 | Collmer | F23D 11/406 237/12.3 C |
| 2018/0094806 | A1 * | 4/2018 | Kido | F23D 3/40 |

FOREIGN PATENT DOCUMENTS

| | | | |
|---|---|---|---|
| JP | S5821715 | U | 2/1983 |
| JP | H0217306 | A | 1/1990 |
| JP | H02106603 | A | 4/1990 |
| JP | H02140120 | U | 11/1990 |
| JP | H02287006 | A | 11/1990 |
| JP | H2553419 | Y2 | 7/1997 |
| JP | 2002013706 | A | 1/2002 |
| JP | 2002147715 | A | 5/2002 |
| JP | 2003090512 | A | 3/2003 |
| JP | 3792116 | B2 | 4/2006 |
| WO | 2016195046 | A1 | 12/2016 |
| WO | 2017005241 | A1 | 1/2017 |

OTHER PUBLICATIONS

International Search Report (with English translation) and Written Opinion issued in corresponding International Patent Application No. PCT/JP2017/033274, 11 pages (dated Oct. 19, 2019).

* cited by examiner (a)

(b)

(a)

(b)

EVAPORATION TYPE BURNER

TECHNICAL FIELD

The present invention relates to an evaporation type burner. More specifically, the present invention relates to an evaporation type burner which can attain light-up and stable combustion of fuel at an early stage.

BACKGROUND ART

Hazardous substances, such as fine particles of soot (PM: Particulate Matter) and nitrogen oxides (NOx), for example, are contained in exhaust discharged from an internal combustion engine, such as a diesel engine. Therefore, from the viewpoint of environmental protection, etc., exhaust emission control by preparing a filter (DPF) for collecting the PM and an exhaust purification means such as an NOx reduction catalyst in an exhaust path of an internal combustion engine to removing the PM and NOx has been performed widely, for example.

By the way, since the PM accumulates on the DPF according to operation of an internal combustion engine, it is necessary to burn the accumulated PM at a predetermined timing to restore the DPF. Moreover, it becomes difficult to remove NOx by reduction since temperature of the catalyst is low and the catalyst is not activated when temperature of the exhaust is low, for example, on a cold start of the internal combustion engine, etc. Therefore, in order to remove NOx contained in the exhaust, it is necessary to raise the temperature of the NOx reduction catalyst up to temperature sufficient for activating the NOx reduction catalyst.

Then, in the art, it has been known to raise temperature of exhaust which flows into an exhaust purification means, such as a DPF and a NOx reduction catalyst, by burning fuel in a burner (combustor) disposed in an exhaust path to generate hot combustion gas (for example, refer to the Patent Document 1 (PTL1)). In accordance with this, opportunities to burn PM accumulated on a DPF to restore the DPF can be increased, and/or temperature of a NOx reduction catalyst can be quickly raised to activate the NOx reduction catalyst at an early stage. As a result, hazardous substances (PM and NOx) contained in exhaust discharged from an internal combustion engine can be removed effectively to purify the exhaust. Moreover, it has been also known to use such a burner as a heater for vehicle for heating a cabin of a vehicle (for example, refer to the Patent Document 2 (PTL2)).

As a burner as mentioned above, for example, an evaporation type burner, in which fuel is impregnated into a wick (impregnation member) disposed at an end of a combustion chamber and vapor of the fuel generated from the wick is heated by a glow plug disposed in the vicinity of the wick to be lit and burned, has been conventionally known. In order to increase opportunities to restore a DPF, to activate a NOx reduction catalyst at an early stage and to start heating a cabin of a vehicle at an early stage by using such a burner, it is necessary to attain light-up and stable combustion of fuel in the burner at an early stage.

In order to do the above, it is desirable to make fuel permeate the whole wick to evaporate the fuel from the whole surface of the wick. However, when feed rate (supply amount) of fuel is large, for example, at a time point of light-up, etc., the fuel may pass through the wick (exude out of the wick) still in its liquid state before the fuel spreads all over the wick, and it may become difficult to evaporate the fuel from the whole surface of the wick.

Then, in the art, it has been known to arranging a fuel distribution means which includes many fuel distribution grooves formed radially from an approximately center part on an inner bottom surface of a casing and distributes fuel from a fuel supply mechanism throughout the whole surface of the wick in front of a point where the fuel reaches the wick, in a combustion type heater (evaporation type burner) (for example, refer to the Patent Document 3 (PTL3)). In accordance with this, it is regarded as possible to start operation of the combustion type heater earlier by shortening transit time for the fuel to spread all over the wick and heat-up time of the wick itself.

However, by newly preparing the fuel distribution means for evenly spreading fuel all over the wick as mentioned above, problems, such as a complicated configuration of an evaporation type burner, an increased number of parts and increased manufacturing cost, for example, may be caused. Moreover, when feed rate of fuel is small, the fuel may not spread all over the whole fuel distribution grooves (the fuel distribution grooves are not filled with the fuel), but the fuel may be collected (stagnated) at a lower part of the fuel distribution means. As a result, there is a possibility that it may become difficult to spread fuel evenly over the whole wick to attain light-up and stable combustion of fuel at an early stage.

CITATION LIST

Patent Literature

[PTL1] Japanese Unexamined Utility Model Application Publication No. 02-140120

[PTL2] Japanese Utility Model Registration No. 2553419

[PTL3] Japanese Patent No. 3792116

SUMMARY OF INVENTION

Technical Problem

As mentioned above, in the art, an evaporation type burner which can attain light-up and stable combustion of fuel at an early stage by evenly distributing fuel supplied from a fuel supply part to an impregnation member (wick) inside of the impregnation member has been demanded. The present invention has been conceived in order to meet such a demand.

Solution to Problem

As a result of wholeheartedly research, the inventor has found out that it is important to prevent fuel from passing through an impregnation member while the fuel has been a liquid still in its liquid state when supply amount of the fuel is large, in order to meet a demand as mentioned above.

In view of the above, an evaporation type burner according to the present invention (which may be referred to as a "present invention burner" hereafter) comprises a combustion chamber, an impregnation member, a fuel supply part, and an igniting device.

The combustion chamber is a space defined by an inside housing that is a bottomed cylindrical container consisting of a bottom wall and a peripheral wall. The impregnation member is a member disposed at a first end that is an end on the bottom wall side of the inside housing in the combustion chamber and has capillary structure and/or porous structure. The fuel supply part supplies fuel to the impregnation member to impregnate the fuel into the impregnation member. The igniting device heats vapor of the fuel evaporating from the impregnation member to lights up the vapor. Furthermore, a plurality of air-supply holes which is opened to the combustion chamber and supplies air to the combustion chamber is formed in the peripheral wall of the inside housing.

In addition, the present invention burner further comprises an exudation prevention member which is a member having fuel permeability lower than that of the impregnation member. The fuel permeability is a characteristic value corresponding to permeability of the fuel. This exudation prevention member is disposed at least in an opposite region which is a surface region of the impregnation member opposes to a infiltration region which is a surface region of the impregnation member where the fuel infiltrates into the impregnation member across the impregnation member.

The exudation prevention member may be an impermeable member through which the fuel cannot permeate. Moreover, the exudation prevention member may be a member separate from said impregnation member. In this case, the exudation prevention member may be connected with said impregnation member by sintering.

Furthermore, the whole of the exudation prevention member may be embedded inside of the impregnation member. Alternatively, the whole of the exudation prevention member may be disposed outside of the impregnation member. Alternatively, a part of the exudation prevention member may be embedded inside of the impregnation member while the other part of the exudation prevention member is projected from a surface of said impregnation member. In this case, the part of the exudation prevention member, which is embedded inside of the impregnation member, may be included in the part of the exudation prevention member, which is projected from the surface of the impregnation member, in a projection onto a plane perpendicularly intersecting with an axis direction of the inside housing. In addition, a level difference (step) may be formed at an interface between the impregnation member and the part of the exudation prevention member, which is projected from the surface of the impregnation member.

In one aspect of the present invention, the present invention burner further comprises a partition member disposed at a prescribed interval from the impregnation member on the side nearer to a second end than the impregnation member in the combustion chamber. The second end is an end on an opposite side to said first end of said combustion chamber. In addition, a light-up space which is a space located on the first end side rather than the partition member in the combustion chamber and a combustion space which is a space located on the second end side rather than the partition member in the combustion chamber are in communication with each other through at least a part of a gap and/or through-hole formed in the partition member.

In this case, the exudation prevention member may be constituted as a part of the partition member. In addition, the partition member does not have to be connected with the inside housing.

In another aspect of the present invention, the axis direction of the inside housing is a horizontal direction. Furthermore, no air-supply hole is formed on an upper side in a vertical direction than a tip of said igniting device in said combustion chamber, at least at a position, which is first distance away to said second end side from said impregnation member in the axis direction of said inside housing, on said peripheral wall of said inside housing. The above-mentioned "first distance" is distance between the impregnation member and an air-supply hole nearest to the impregnation member in the axis direction of the inside housing among the plurality of the air-supply holes.

In this case, the evaporation type burner may be configured such that no air-supply hole is formed on the upper side in the vertical direction than a center of the combustion chamber, at least at a position, which is the first distance away to the second end side from the impregnation member in the axis direction of the inside housing, on the peripheral wall of the inside housing.

Advantageous Effects of Invention

As mentioned above, in the evaporation type burner according to the present invention (present invention burner), the exudation prevention member which has fuel permeability lower than fuel permeability of the impregnation member is disposed at least in the opposite region. The above-mentioned "opposite region" is a surface region of the impregnation member opposite to a surface region (infiltration region) of the impregnation member where the fuel infiltrates into the impregnation member, across the impregnation member. Thereby, even when feed rate of fuel is large, for example, at a time point of light-up, etc., the possibility that the fuel may pass through the wick (exude out of the wick) still in its liquid state can be reduced.

At least a part of the fuel suppressed from passing through the wick (exuding out of the wick) still in its liquid state by the exudation prevention member in this way is dispersed in directions along the interface between the exudation prevention member and the impregnation member. In other words, at least a part of the fuel which has permeated through the impregnation member and has reached the exudation prevention member is dispersed so as to spread in the inside of the impregnation member. Therefore, although an impregnation amount (permeation amount) of the fuel to the opposite region of the impregnation member decreases, an area of a region from which the fuel can evaporate in the surface of the impregnation member can be increased since the impregnation amount (permeation amount) of the fuel around the opposite region (to an outer edge (periphery) of the opposite region) of the impregnation member increases.

As a result, as compared with an evaporation type burner according to a conventional technology (which may be referred to as a "conventional burner" hereafter) which does not comprise the exudation prevention member, the fuel can be spread evenly over the whole impregnation member. Therefore, in accordance with the present invention burner, light-up and stable combustion of fuel can be attained at an early stage.

Moreover, in a case where a part of the exudation prevention member is embedded inside of the impregnation member while the other part of the exudation prevention member is projected from a surface of the impregnation member as mentioned above, the part of the exudation prevention member, which is embedded inside of the impregnation member, may be included in the part of the exudation prevention member, which is projected from the surface of the impregnation member, in a projection onto a plane perpendicularly intersecting with an axis direction of the inside housing. In other words, the part of the exudation prevention member, which is projected from the surface of the impregnation member, may extend (spread) along the surface of the impregnation member (for example, in a shape of a flange).

In accordance with this, even when the fuel which has permeated through the impregnation member and has reached the exudation prevention member oozes out to an outer edge of the opposite region of the impregnation member along an interface between the impregnation member and the part of the exudation prevention member, which is embedded inside of the impregnation member, a possibility that "re-impregnation" may occur increases. The re-impregnation is a phenomenon that fuel spreads along an interface between the impregnation member and the part of the exudation prevention member, which is projected from the surface of the impregnation member, and is impregnated into the impregnation member again. As a result, a possibility that the fuel may ooze out to the outer edge of the opposite region of the impregnation member along the interface between the impregnation member and the part of the exudation prevention member, which is embedded inside of the impregnation member, still in its liquid state can be reduced, and the fuel can be more certainly spread over the whole impregnation member evenly.

Furthermore, a possibility that combustion gas may flow backward to the vicinity of the impregnation member due to pressure fluctuation of exhaust in association with power variation of an internal combustion engine, etc., for example, and problems such as a misfire and/or combustion failure may arise in the present invention burner can be reduced by further comprising the partition member as mentioned above. Moreover, in this case, by constituting the preventing member as a part of the partition member as mentioned above, a number of component parts can be reduced and consequently, for example, simplification of a manufacturing process and reduction of a manufacturing cost, etc. can be attained since it becomes unnecessary to connect the partition member to the inside housing.

In addition, as mentioned above, by forming the air-supply holes nearest to the impregnation member only in a lower region (region on the lower side in the vertical direction) than the tip of the igniting device or the center of the combustion chamber when the present invention burner is used in a state where the axis direction of the inside housing is a horizontal direction, a possibility that flame generated from fuel ignited by the igniting device may be blown from the above and thereby the flame may disappear and/or combustion thereof may become unstable can be reduced.

When the whole exudation prevention member is disposed outside of the impregnation member, or when a part of the exudation prevention member is projected from the surface of the impregnation member, an air flow swirling around the exudation prevention member as a center can be produced by arranging the air-supply holes as mentioned above. Thereby, the flame generated from fuel ignited by the igniting device can spread easily along an outer edge of the exudation preventing member, and light-up and stable combustion of fuel can be attained more certainly at an early stage.

Other objectives, other features, and accompanying advantages of the present invention will be easily understood from the following explanation about various embodiments of the present invention described referring to drawings.

DESCRIPTION OF EMBODIMENTS

First Embodiment

Hereafter, an example of a configuration of an evaporation type burner according to a first embodiment of the present invention (which may be referred to as a "first burner" hereafter) will be explained in more detail referring to drawings.

<Configuration of Burner>

Figure 1:
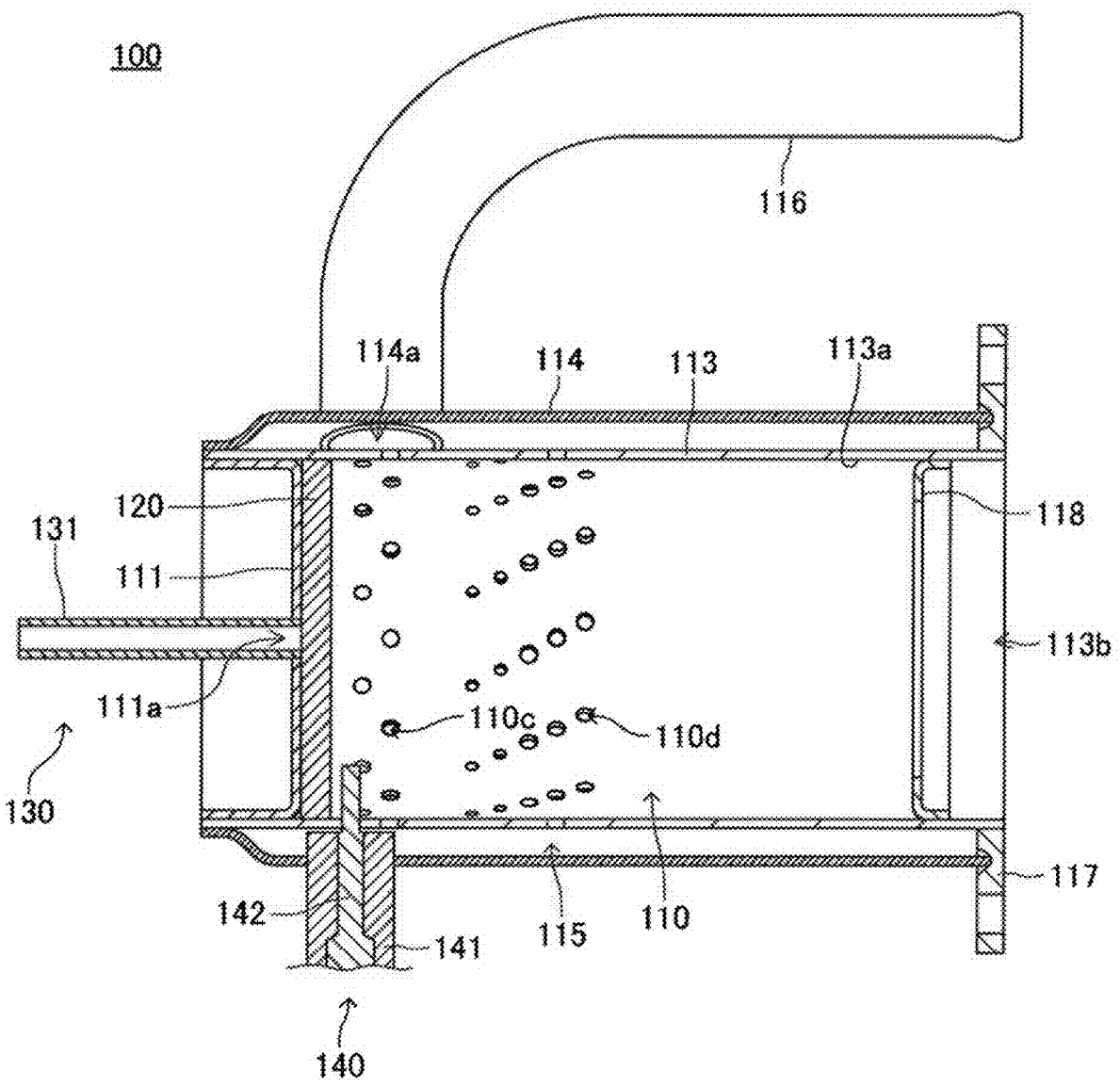
FIG. 1 is a schematic sectional view of an evaporation type burner according to a first embodiment and second embodiment of the present invention (first burner and second burner) taken along a plane including an axis of an inside housing.

FIG. 1 is a schematic sectional view of the first burner taken along a plane including an axis of an inside housing which defines a combustion chamber. In the following explanation, an upper side in a vertical direction in a state where the first burner is used (for example, a state where the first burner is mounted on a vehicle, etc.) (upper side on a page of FIG. 1) is defined as an "upper side", and a lower side which is opposite side thereto is defined as a "lower side." Furthermore, a left side when facing the page of FIG. 1 (the impregnation member side) is defined as an "upstream side" and a right side which is opposite side thereto is defined as a "downstream side."

The first burner is an evaporation type burner which comprises a combustion chamber, an impregnation member, a fuel supply part, and an igniting device, as mentioned above. The combustion chamber is a space defined by an inside housing that is a bottomed cylindrical container consisting of a bottom wall and a peripheral wall. The impregnation member is a member disposed at a first end that is an end on the bottom wall side of the inside housing in the combustion chamber and has capillary structure and/or porous structure. The fuel supply part supplies fuel to the impregnation member to impregnate the fuel into the impregnation member. The igniting device heats vapor of the fuel evaporating from the impregnation member to lights up the vapor.

The first burner 100 shown in FIG. 1 comprises an outside housing 114 and an inside housing 113 disposed inside the outside housing 114. Shapes of the outside housing 114 and the inside housing 113 are not limited and can be properly designed depending on an intended use and usage environment, etc. of the first burner 100, for example. In this example, the outside housing 114 is formed as a cylindrical peripheral wall and the inside housing 113 is formed as a bottomed cylindrical container. This container consists of a peripheral wall 113*a*, which is cylindrical and coaxial with the peripheral wall of the outside housing 114, and a bottom wall 111, which is disposed at an upstream side end of the peripheral wall 113*a* (first end).

Between the peripheral wall of the outside housing 114 and the peripheral wall 113*a* of the inside housing 113, an air-supply path 115 which is a space with its both ends on the upstream side and downstream side closed is formed. They are configured such that an air inlet 114*a* which is an opening is formed in the peripheral wall of the outside housing 114, an air-supply pipe 116 is connected to this air inlet 114*a*, and air is supplied to the air-supply path 115 in the outside housing 114 by an air-supply means which is not shown. A flow rate of the air supplied to the air-supply path 115 can be arbitrarily changed by a flow rate control part which is not shown.

In this example, the air inlet 114*a* is formed in the vicinity of the first end of the combustion chamber 110, and the air-supply pipe 116 is connected to this air inlet 114*a*. However, as long as it is possible to supply air to the inside of the combustion chamber 110, a connection point of the air-supply pipe 116 is not limited in particular.

In addition, a layer of the air supplied through the air-supply path 115 formed between the peripheral wall of the outside housing 114 and the peripheral wall 113*a* of the inside housing 113 as mentioned above can function as a heat insulating layer. As a result, on combustion of fuel, heat inside the combustion chamber 110 can be prevented from being conducted to the outside housing 114 to give influence caused by heat to equipment other than the first burner 100, etc. A mounting member 117 which consists of a flange, etc. is formed at an end on the downstream side of the outside housing 114 so as to project outward.

The combustion chamber 110 is a space defined by the inside housing 113. The impregnation member 120 is disposed at a first end that is an end on the side of the bottom wall 111 of the inside housing 113 (upstream side). Therefore, substantially, a space on the downstream side of the impregnation member 120 in an interior space of the inside housing 113 corresponds to the combustion chamber 110. On the other hand, a second end (downstream side end), which is an end on the side opposite to the first end (upstream side end), of the inside housing 113 is opened as an opening 113*b*.

In addition, in this example, an orifice 118 is fitted in the second end of the inside housing 113 to make the cross section of the combustion chamber 110 smaller (namely, a flow channel of combustion gas is narrowed). This leads to turning a part of combustion gas which has arrived at the second end of the combustion chamber 110 to the upstream side to promote mixing of gases in the combustion chamber 110 as well as returning unburned fuel to the upstream side to burning the fuel. However, a technique for making smaller the cross section of the downstream part of the combustion chamber 110 is not limited to the above, an orifice may be formed by bending inward the peripheral wall 113*a* of the inside housing 113 other than disposing the orifice 118 as a separate part as mentioned above. Moreover, in the evaporation type burner an according to the present invention, it is not an essential constituent element to make smaller the cross section on the second end side of the combustion chamber 110, and an orifice does not have to be formed as mentioned above.

The impregnation member 120 is formed of material which has heat resistance and chemical stability (for example, corrosion resistance, etc.) against fuel, etc. and can be impregnated with fuel in its inside. Specifically, the impregnation member 120 is a member which is formed of material such as metal and ceramic material and has capillary structure and/or porous structure. In this example, a wick formed by compacting (pressing together) metal fiber and/or ceramic fiber is used as the impregnation member 120.

Moreover, although a shape of the impregnation member 120 is not limited in particular, the impregnation member 120 is formed in a shape of a disc, and is disposed so as to cover the whole cross section of the combustion chamber 110 taken along a plane perpendicularly intersecting with the axis of the inside housing 113.

A through-hole 111*a* is formed in the bottom wall 111 of the inside housing 113, and a fuel supply pipe 131 is connected to this through-hole 111*a*. Thereby, fuel is supplied through the fuel supply pipe 131 from a fuel supply apparatus, which is not shown, to a principal surface on the upstream side of the impregnation member 120. A position of the through-hole 111*a* in the bottom wall 111 (namely, position where the fuel supply pipe 131 is connected to) is not limited as long as it is possible to supply fuel to the impregnation member 120. In this example, the fuel supply pipe 131 is connected to a position of the bottom wall 111 corresponding to the center of the principal surface on the upstream side of the impregnation member 120. The above-mentioned fuel supply apparatus and fuel supply pipe 131 constitute the fuel supply part 130.

Furthermore, an igniting device 140 is disposed at a position corresponding to the vicinity of an outside end in a radial direction of the impregnation member 120, in the outside housing 114. Specifically, an igniting device mounting member 141 is disposed on a lower side of the outside housing 114. The igniting device mounting member 141 is configured such that a tip (end on the side of the combustion chamber 110) of the igniting device mounting member 141 reaches the inside of the air-supply path 115, but does not contact with the inside housing 113. Thereby, on combustion of fuel, heat inside the combustion chamber 110 can be prevented from being conducted to the outside housing 114 through the igniting device mounting member 141 to give influence caused by heat to equipment other than the first burner 100, etc.

An igniting means 142 is fixed to the igniting device mounting member 141. The igniting means 142 is not limited in particular as long as it is possible to heat vapor of fuel evaporating from the impregnation member 120 to light up the vapor, and arbitrary means, such as a spark plug, can be used, for example. In this example, a glow plug is used as the igniting means 142.

An arrangement position of the igniting means 142 is not limited in particular as long as it is possible to heat vapor of fuel evaporating from the impregnation member 120 to light up the vapor. Typically, the igniting means 142 is disposed in the vicinity of the downstream side of the impregnation member 120. When the combustion chamber 110 is divided by the partition member into a light-up space on the upstream side and a combustion space on the downstream side as will be mentioned later, the igniting means 142 is disposed so as to be exposed to the light-up space. In this example, the igniting means 142 is disposed so as to project upward in the vicinity of the impregnation member 120 in the combustion chamber 110 from the peripheral wall 113*a* of the inside housing 113 below the center in an up-and-down direction of the impregnation member 120.

In the peripheral wall 113*a* of the inside housing 113, first air-supply holes 110*c*, which are opened to the upstream side of the combustion chamber 110 and supply air to the combustion chamber 110, and second air-supply holes 110*d*, which are opened to the downstream side of the combustion chamber 110 and supplies air to the combustion chamber 110, are formed. Hereafter, the first air-supply holes 110*c* and the second air-supply holes 110*d* may be collectively referred to as "air-supply holes". In this example, the first air-supply holes 110*c* which consists of a plurality of small holes drilled in the peripheral wall 113*a* of the inside housing 113 are formed at the predetermined interval over the whole circumferential direction of the peripheral wall 113*a*. However, as will be mentioned later, the second air-supply holes 110*d* may be formed only in a part of the peripheral wall 113*a* (for example, in the lower part, etc.), rather than being formed over the whole circumferential direction of the peripheral wall 113*a*.

The inside housing 113, the outside housing 114, the air-supply pipe 116, the impregnation member 120, the fuel supply pipe 131, the igniting device mounting member 141 and the igniting means 142, as well as members constituting these and positioning and fixing of members associated with these in the first burner 100 can be carried out by a well-known technique such as welding, etc., for example.

Moreover, materials which form various components including the above, which constitute the first burner 100, etc., can be properly chosen and designed taking into consideration load, vibration, temperature and pressure, etc., which are expected in a usage environment and usage condition of the first burner 100. However, since the materials for these components, etc. is well-known to a person skilled in the art, further explanation will be omitted.

In addition, in FIG. 1, the exudation prevention member which the first burner 100 comprises is omitted. Although details of the exudation prevention member will be explained in detail later, prior to the explanation, properties required for the impregnation member will be explained below, with focus on a relationship with passing through the impregnation member (exuding out of the impregnation member) of fuel.

<Properties of Impregnation Member>

As properties required for the impregnation member, for example, ability to hold (be impregnated with) an amount of fuel enough for generating an amount of vapor of the fuel sufficient to light up the fuel by the igniting device and maintain combustion after light-up in the combustion chamber, and ability to quickly disperse the fuel supplied from the fuel supply part inside the impregnation member by supply pressure from the fuel supply part and/or a capillary phenomenon, etc.

The properties as mentioned above change with an affinity between the fuel and the material which constitutes the impregnation member, minuteness and porosity of internal structure of the impregnation member, and size and shape of the impregnation member (for example, thickness and area, etc.), etc., for example. However, actually, there are constraints on the material of constituents which constitutes the impregnation member, the size and shape of the impregnation member, and the manufacturing conditions (for example, pressure for compacting (pressing together) the constituents, etc.), naturally.

Moreover, it is thought that the higher the porosity of the impregnation member is, the more fuels can be held (impregnated) inside the impregnation member. However, when the porosity is excessively high, it becomes difficult to hold (impregnate) fuel inside the impregnation member. As a result, there is a possibility that the fuel still in its liquid state may flow down to and be collected in a lower part of the combustion chamber and/or the fuel may pass through the impregnation member to exude out of the surface of the impregnation member on the opposite side to the fuel supply part still in its liquid state. Conversely, when the porosity is excessively low, although it is necessary to raise the supply pressure of the fuel by the fuel supply part in order to make the fuel infiltrate into the inside of the impregnation member, there is a possibility that the fuel may pass through the impregnation member to exude out of the surface of the impregnation member on the opposite side to the fuel supply part still in its liquid state again, since the amount of the fuel which can be held (impregnated) inside the impregnation member is small due to the low porosity.

For the above reasons, in order to prevent fuel from passing through (exuding out of) the impregnation member as mentioned above in the conventional burner, it has been necessary to suppress supply rate of fuel by the fuel supply part to be less than a predetermined threshold according to properties of the impregnation member. For this reason, in the conventional burner, even when it is necessary to raise the supply rate of fuel, for example, at a time point of light-up, etc., the supply rate of fuel cannot be sufficiently raised and it is difficult to attain light-up and stable combustion of fuel at an early stage.

<Mechanism of Passing-Through of Fuel>

Then, as a result of wholeheartedly research, the present inventor has obtained knowledge as follows. First, on the passing-through (exuding-out) of fuel as mentioned above, thickness of the impregnation member affects greatly. Specifically, the larger the thickness of the impregnation member is, the more unlikely to occur the passing-through (exuding-out) of fuel as mentioned above becomes. However, as a matter of design and specification of an evaporation type burner, the thickness of the impregnation member cannot be enlarged without any limitation.

When the thickness of the impregnation member is kept constant, the minuter the internal structure of the impregnation member becomes (namely, the smaller the porosity thereof becomes), the lower the permeability of fuel becomes (the more unlikely to exude out the fuel becomes). Therefore, as mentioned above, in order to maintain the supply rate of fuel at a desired extent, the minuter the internal structure of the impregnation member becomes, the more it is necessary to raise the supply pressure of fuel by the fuel supply part. However, the minuter the internal structure of the impregnation member becomes, the lower the porosity of the impregnation member becomes, and the smaller the amount of fuel which can be held (impregnated) inside the impregnation member becomes. As a result, the possibility that the fuel may pass through the impregnation member to exude out of the surface of the impregnation member on the opposite side to the fuel supply part still in its liquid state increases.

Moreover, the amount of the fuel which passes through the impregnation member to exude out of the surface of the impregnation member on the opposite side to the fuel supply part still in its liquid state as mentioned above is also influenced by infiltration rate of the fuel due to a capillary phenomenon inside the impregnation member. Specifically, the higher the above-mentioned infiltration rate becomes, the larger the dispersion (spread) of the fuel inside the impregnation member becomes, and the amount of the fuel which passes through the impregnation member still in its liquid state decreases. Conversely, the lower the above-mentioned infiltration rate becomes, the smaller the dispersion (spread) of the fuel inside the impregnation member becomes, and the amount of the fuel which passes through the impregnation member still in its liquid state increases.

The infiltration rate of the fuel due to a capillary phenomenon inside the impregnation member is determined by various factors such as affinity between the fuel and the material constituting the impregnation member, as well as the minuteness and porosity of the internal structure of the impregnation member, for example. Therefore, it can be said that whether the passing-through (exuding-out) of fuel as mentioned above occurs or not is determined by a balance between the supply pressure of the fuel by the fuel supply part and the properties of the impregnation member (specifically, the infiltration rate of the fuel due to a capillary phenomenon inside the impregnation member and the porosity of the impregnation member, etc.).

<Exudation Prevention Member>

Figure 2:
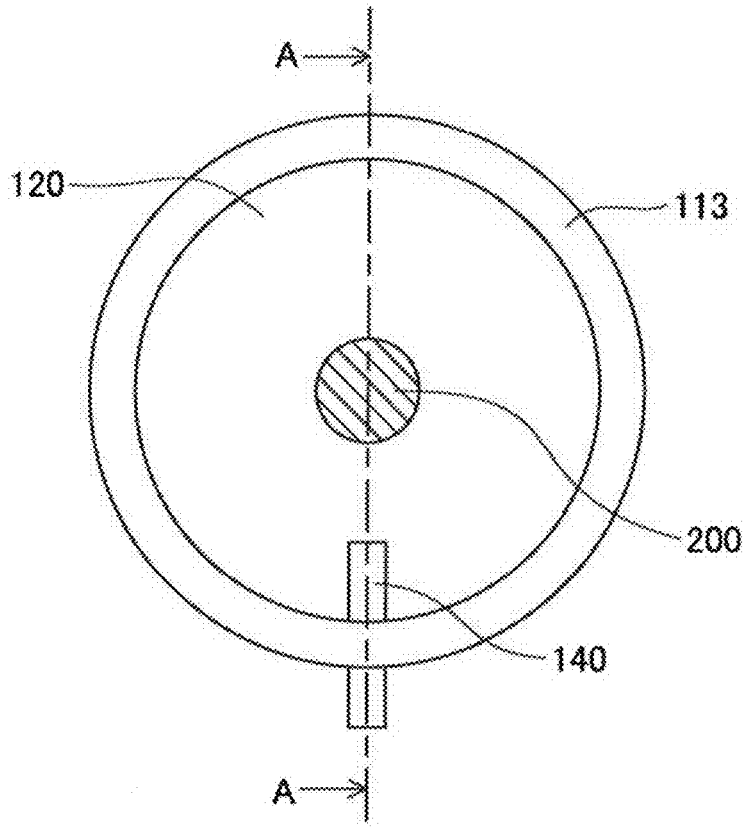
FIG. 2 is a schematic plan view when observing the first burner from the downstream side along the axis direction of the inside housing.
Figure 3:
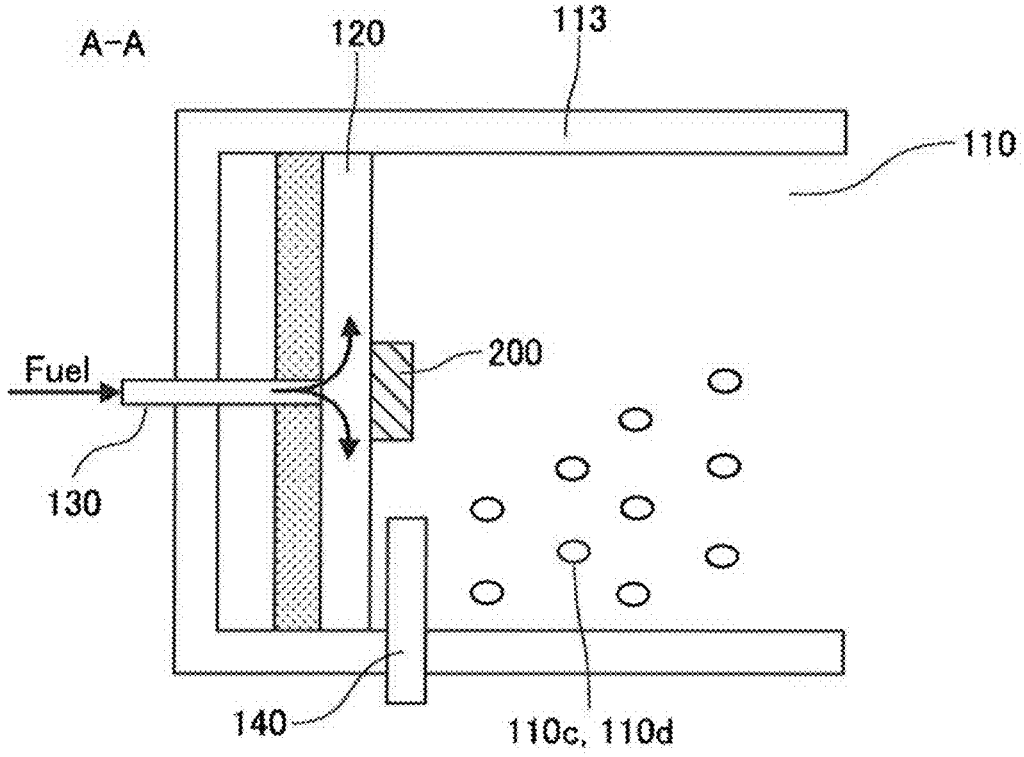
FIG. 3 is a schematic sectional view of the first burner and the second burner taken along a plane including the line A-A shown in FIG. 2.

Therefore, in the first burner 100, as shown in FIG. 2 and FIG. 3, an exudation prevention member 200 which is a member which has fuel permeability lower than fuel permeability of the impregnation member 120 is disposed on the opposite region at least. As mentioned above, this "opposite region" is a surface region of the impregnation member 120 opposite to a surface region of the impregnation member where the fuel infiltrates into the impregnation member 120 (infiltration region) across the impregnation member 120.

In FIG. 2 and FIG. 3, for the purpose of making easy understanding of the present invention, components of the first burner 100, other than the combustion chamber 110, the air-supply holes 110*c* and 110*d*, the inside housing 113, the impregnation member 120, the fuel supply part 130, the igniting device 140 and the exudation prevention member 200, are omitted. Moreover, FIG. 2 is a plan view when observing these components which the first burner 100 comprises from the downstream side (second end side) along the axis direction of the inside housing 113. FIG. 3 is a schematic sectional view of these components which the first burner 100 shown in FIG. 2 comprises taken along a plane including the line A-A shown in FIG. 2. However, in FIG. 3, for the purpose of making easy understanding of the present invention, the air-supply holes 110*c* and 110*d* which should have not appeared in the sectional view are also illustrated.

The infiltration region corresponds to a region where the fuel supplied to the impregnation member 120 through the inside of the fuel supply pipe 131 contacts with the surface on the first end side of the impregnation member 120 as shown by a straight arrow illustrated on the left end of FIG. 3. Moreover, the opposite region where the exudation prevention member 200 is disposed is a surface region on the first end side of the impregnation member 120 opposite to the above-mentioned infiltration region, and a contact surface between the exudation prevention member 200 and the impregnation member 120 includes the opposite region as apparent from FIG. 2 and FIG. 3.

In addition, the exudation prevention member 200 is a member which has fuel permeability lower than fuel permeability of the impregnation member 120 as mentioned above. Here, the "fuel permeability" is an index of easiness (likelihood) for fuel to permeate, and is a characteristic value corresponding to permeability of fuel. As a specific example of such an index, permeability k intrinsic to a medium in the Darcy rule expressed by the following formula (1), etc. can be mentioned, for example.

$$\frac{Q}{A} = -\frac{k}{\mu} \times \frac{dp}{dx} \quad (1)$$

In the above formula, Q is a flow rate of fluid (fuel) which passes through a medium (the impregnation member 120 and the exudation prevention member 200), A is a cross section of the medium through which the fluid passes, p is viscosity of the fluid, and dp/dx is a pressure gradient along a flow channel.

However, a fuel permeability is not limited to the above, and any other characteristic values can be employed as the fuel permeability as long as it is an index of easiness (likelihood) for fluid (fuel) to permeate in a medium (the impregnation member 120 and the exudation prevention member 200) and is a characteristic value corresponding to permeability of fluid in the medium.

The exudation prevention member 200 is formed of material which has heat resistance and chemical stability (for example, corrosion resistance, etc.) against fuel, etc. Specifically, the exudation prevention member 200 is formed of metal, ceramic material, etc., for example.

The exudation prevention member 200 may be a member which has capillary structure and/or porous structure (for example, a wick formed by compacting (pressing together) metal fiber and/or ceramic fiber) just like the impregnation member 120, or it may be an impermeable member through which the fluid (fuel) cannot permeate.

In the case of the former, at least a part of the fuel which has permeated through the impregnation member 120 and has reached the exudation prevention member 200 can also permeate through the exudation prevention member 200 to transpire in the combustion chamber 110. Therefore, since the amount of vapor of the fuel supplied to the combustion chamber 110 increases, it is desirable from a viewpoint of attaining light-up and stable combustion of the fuel at an early stage. On the other hand, in the case of the latter, since the exudation prevention member 200 does not allow the fuel to permeate, the possibility that the fuel may pass through the impregnation member 120 (wick) (exude out of the impregnation member 120 (wick)) still in its liquid state can be reduced even when feed rate of the fuel is large, for example, at a time point of light-up, etc.

In addition, the exudation prevention member 200 may be constituted as a member separate from the impregnation member 120. In this case, although a method for connecting the exudation prevention member 200 and the impregnation member 120 is not limited in particular, a method which can withstand heat generated by combustion of the fuel and thermal deformation due to the heat is desirable. From such a viewpoint, the exudation prevention member 200 may be connected with the impregnation member 120 by sintering. Specifically, a combination of the exudation prevention member 200 and the impregnation member 120 arranged at a predetermined positional relation can be sintered by heating the combination, at sintering temperature according to respective materials of them, for a predetermined time period, for example, in an infrared-heating furnace, etc., in a state where predetermined pressure is being applied.

<Effectiveness>

In the first burner 100 which has a configuration as mentioned above, the exudation prevention member 200 which has lower fuel permeability as compared with that of the impregnation member 120 is disposed at least in the opposite region (opposite to the infiltration region) of the impregnation member 120. Namely, a region where a possibility that the passing-through (exuding-out) of fuel may occur is high on the surface on the second end side of the impregnation member 120 is covered with a member through which the fuel cannot permeate easily (or at all).

In accordance with the above-mentioned configuration, in the first burner 100, the possibility that the fuel may pass through the impregnation member 120 (exude out of the impregnation member 120) still in its liquid state can be reduced even when feed rate of the fuel is large, for example, at a time point of light-up, etc.

At least a part of the fuel suppressed from passing through (exuding out of) the impregnation member 120 by the exudation prevention member 200 in its liquid state is distributed in a direction along with the interface between the exudation prevention member 200 and the impregnation member 120 as shown by the curved arrows illustrated in FIG. 3. In other words, at least a part of the fuel which has permeated through the impregnation member 120 and has reached the exudation prevention member 200 is distributed so as to spread radially inside the impregnation member 120.

As a result of the above, although the impregnation amount (permeation amount) of the fuel into the opposite region of the impregnation member 120 decreases, the impregnation amount (permeation amount) of the fuel around the opposite region (to an outer edge (periphery) of the opposite region) of the impregnation member 120 increases. Therefore, an area of a region from which the fuel can evaporate in the surface of the impregnation member 120 is increased. Thus, the first burner 100 can spread the fuel over the whole impregnation member 120 more evenly as compared with the conventional burner which does not comprise the exudation prevention member 200. Namely, in accordance with the first burner 100, light-up and stable combustion of fuel can be attained at an early stage.

<Modification of First Burner>

In the example shown in FIG. 3, the whole exudation prevention member 200 is arranged outside the impregnation member 120. In other words, in the example shown in FIG. 3, the exudation prevention member 200 is arranged on the surface of the impregnation member 120. However, arrangement modes of the exudation prevention member 200 (namely, a positional relation between the impregnation member 120 and the Exudation prevention member 200) is not limited to the above.

Figure 4:
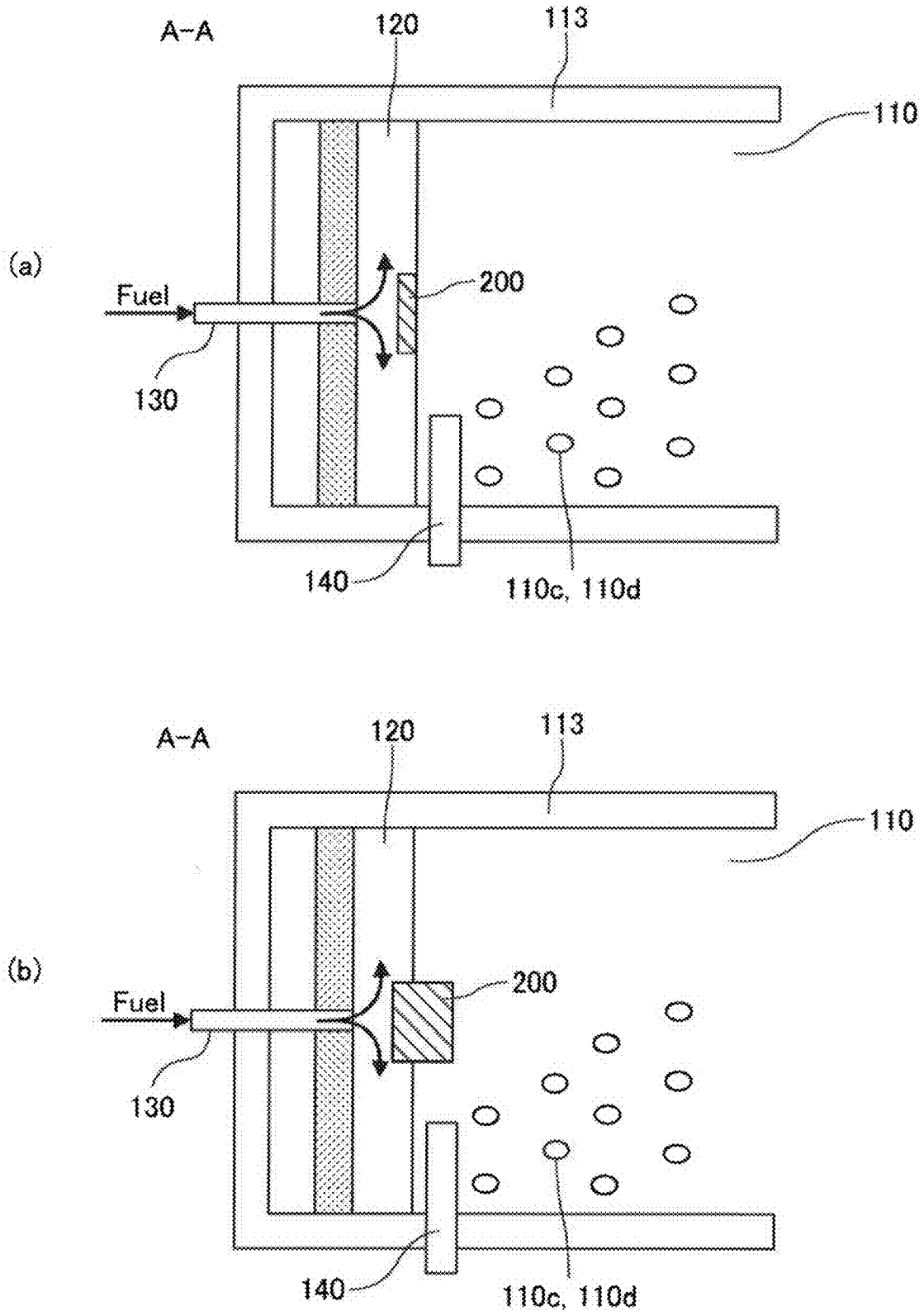
FIG. 4 is a schematic sectional view for showing other specific examples of the exudation prevention member which the first burner and the second burner comprise.

For example, as shown in (a) of FIG. 4, the whole exudation prevention member 200 may be embedded inside the impregnation member 120. However, in (a) of FIG. 4, one surface of the exudation prevention member 200 is exposed so as to be flush with the surface on the downstream side (second end side) of the impregnation member 120.

Alternatively, as shown in (b) of FIG. 4, a part of the exudation prevention member 200 may be embedded inside of the impregnation member 120 while the other part of the exudation prevention member 200 may be projected from a surface of the impregnation member.

When the entirety or a part of the exudation prevention member 200 is embedded inside the impregnation member 120 as the examples shown in (a) and (b) of FIG. 4, bond strength (connection strength) between the exudation prevention member 200 and the impregnation member 120 can be raised since the contact area between the exudation prevention member 200 and the impregnation member 120 is larger as compared with the case where the exudation prevention member 200 is arranged on the surface of the impregnation member 120 as shown in FIG. 3.

Furthermore, since the embedded part of the exudation prevention member 200 which is a member having relatively low fuel permeability has penetrated into the inside of the opposite region of the impregnation member 120, the fuel which has infiltrated into the inside of the impregnation member 120 from the infiltration region permeates into the inside of the impregnation member 120 so as to avoid this embedded part. Thus, fuel can be more certainly spread over the whole impregnation member evenly by preparing the embedded part.

In addition, the shape of the part of the exudation prevention member 200 which is embedded inside the impregnation member 120 (which may be simply referred to as an "embedded part" hereafter) is not limited in particular. When the entirety of the exudation prevention member 200 is embedded inside the impregnation member 120, the shape of the cross section of the embedded part taken along a plane including an axis of the inside housing 113 may be a rectangle as shown in (a) of FIG. 4, it may be a half circle and a triangle as shown in (a) and (b) of FIG. 5, or it may be various shapes including a shape as shown in (c) of FIG. 5.

Figure 5:
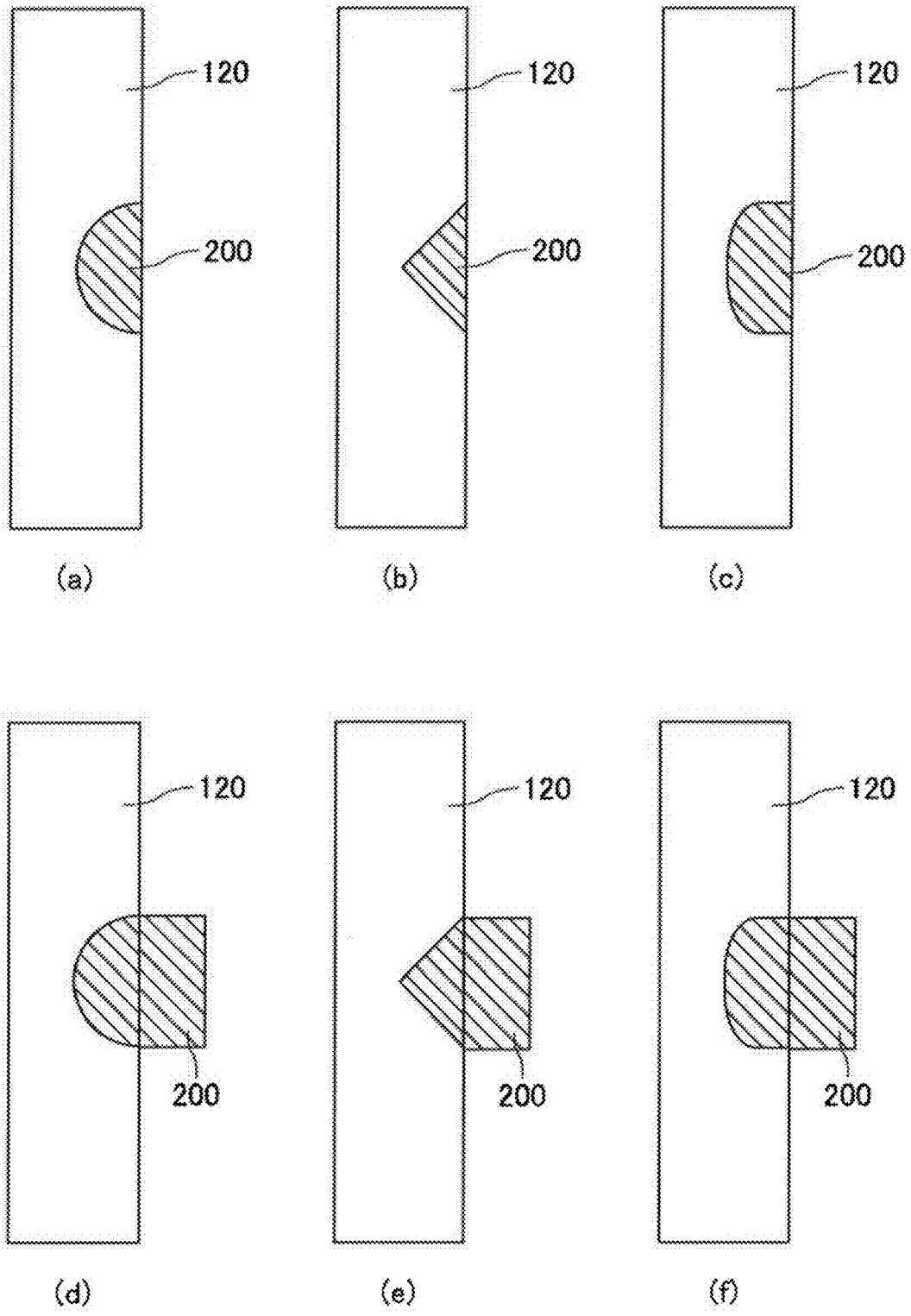
FIG. 5 is a schematic sectional view for showing various specific examples of shapes of an embedded part of the exudation prevention member which the first burner and the second burner comprise.

Also when a part of the exudation prevention member 200 is embedded inside the impregnation member 120 while the other part of the exudation prevention member 200 is projected from a surface of the impregnation member 200, the shape of the cross section of the embedded part taken along a plane including an axis of the inside housing 113 may be a rectangle as shown in (b) of FIG. 4, it may be a half circle and a triangle as shown in (d) and (e) of FIG. 5, or it may be various shapes including a shape as shown in (f) of FIG. 5.

In FIG. 5, for the purpose of making easy understanding about the cross sectional shape of the embedded part of the exudation prevention member 200, only the exudation prevention member 200 and the impregnation member 120 are extracted and indicated among the components of the first burner 100.

By the way, as mentioned above, at least a part of the fuel which has permeated through the impregnation member 120 and has reached the exudation prevention member 200 is distributed so as to spread inside the impregnation member 120. When the embedded part of the exudation prevention member 200 has penetrated into the inside of the opposite region of the impregnation member 120, this effectiveness becomes more remarkable. Namely, the fuel which has infiltrated into the inside of the impregnation member 120 from the infiltration region permeates into the inside of the impregnation member 120 so as to avoid this embedded part. In other words, at least a part of the fuel suppressed from passing through (exuding out of) the impregnation member 120 by the exudation prevention member 200 in its liquid state is distributed in a direction along with the interface between the exudation prevention member 200 and the impregnation member 120.

At this time, the fuel which has permeated through the impregnation member 120 and has reached the exudation prevention member 200 may ooze out to an outer edge of the opposite region of the impregnation member 120 along the interface between the impregnation member 120 and the part of the exudation prevention member 200, which is embedded inside of the impregnation member 120, (embedded part). In this case, at least a part of the fuel which has oozed out is again impregnated into the surface of the impregnation member 120. However, when the amount of the fuel which has oozed out is large, it may flow down to and be collected in a lower part of the combustion chamber 110 without being again impregnated into the surface of the impregnation member 120.

Figure 6:
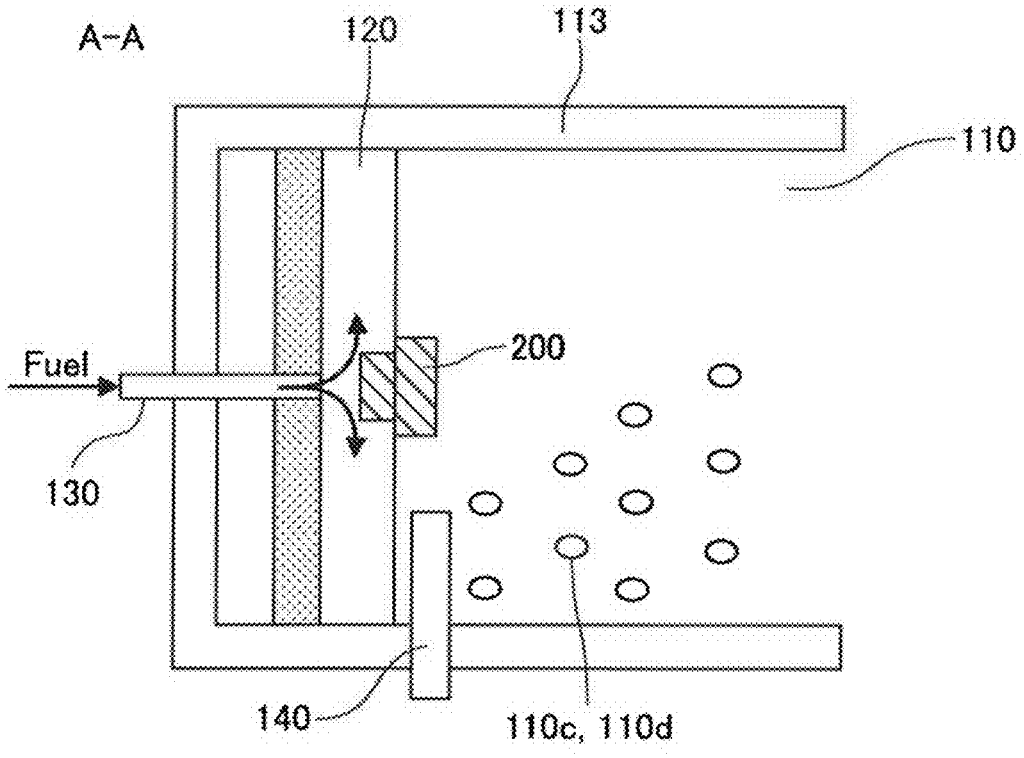
FIG. 6 is a schematic sectional view for showing one specific example of a shape of a projected part of the exudation prevention member which the first burner and the second burner comprise.
Figure 7:
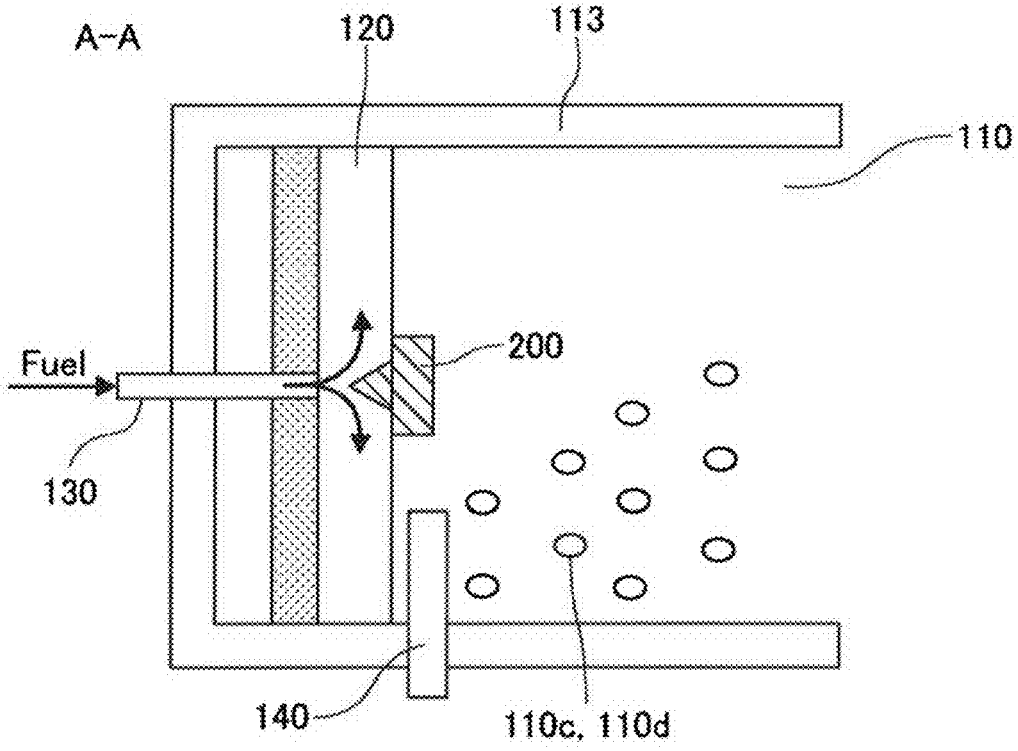
FIG. 7 is a schematic sectional view for showing another specific example of a shape of the projected part of the exudation prevention member which the first burner and the second burner comprise.
Figure 8:
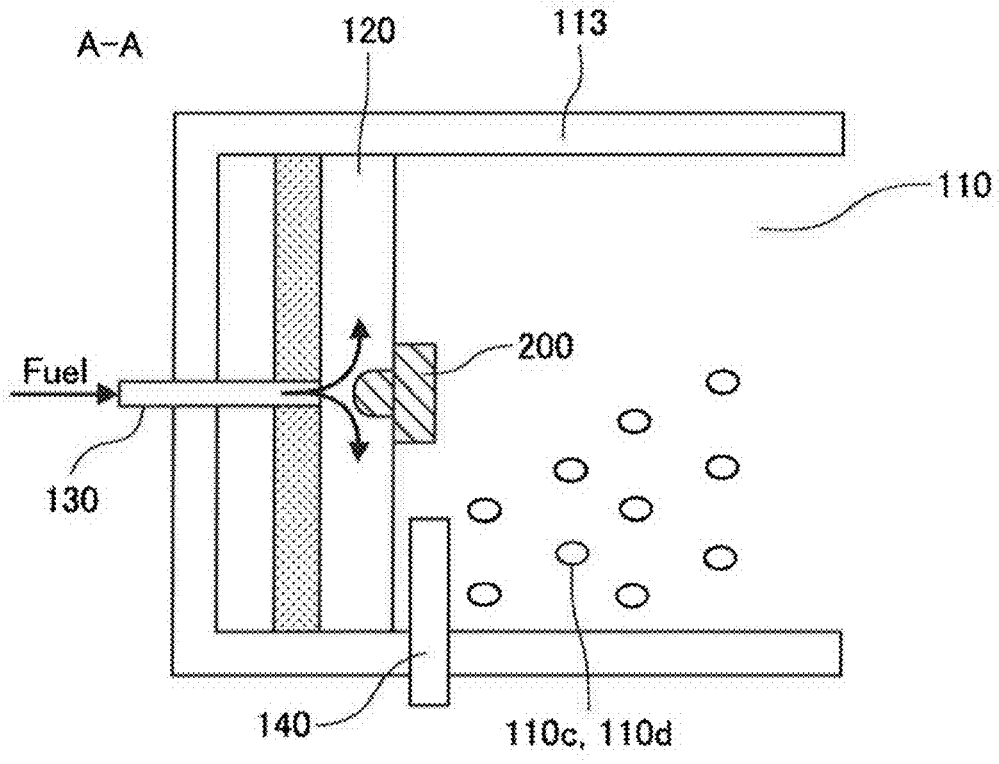
FIG. 8 is a schematic sectional view for showing further another specific example of a shape of the projected part of the exudation prevention member which the first burner and the second burner comprise.

From a viewpoint of preventing the fuel from oozing out to the outer edge of the opposite region of the impregnation member 120 as mentioned above, it is desirable that the part of the exudation prevention member 200, which is embedded inside of the impregnation member 120, is included in the part of the exudation prevention member 200, which is projected from the surface of the impregnation member 120, in a projection onto a plane perpendicularly intersecting with the axis direction of the inside housing 113. In other words, it is desirable that the part of the exudation prevention member 200, which is projected from the surface of the impregnation member 120, extends (spreads) along the surface of the impregnation member 120 (for example, in a shape of a flange), as shown in FIG. 6 to FIG. 8, for example.

In accordance with this, even when the fuel which has permeated through the impregnation member 120 and has reached the exudation prevention member 200 oozes out to an outer edge of the opposite region of the impregnation member along an interface between the impregnation member 120 and the part of the exudation prevention member 200, which is embedded inside of the impregnation member, (embedded part), a possibility that "re-impregnation" may occur increases. The re-impregnation is a phenomenon that the fuel spreads along an interface between the impregnation member 120 and the part of the exudation prevention member 200, which is projected from the surface of the impregnation member, (which may be simply referred to as a "projected part" hereafter), and is impregnated into the impregnation member 120 again meanwhile.

As a result of the above, a possibility that the fuel may ooze out to the outer edge of the opposite region of the impregnation member 120 along the interface between the impregnation member 120 and the part of the exudation prevention member 200, which is embedded inside of the impregnation member 120, (embedded part), still in its liquid state can be reduced, and the fuel can be more certainly spread over the whole impregnation member 120 evenly.

The longer the route (path) through which the fuel that has penetrated the impregnation member 120 and has reached the exudation prevention member 200 oozes out to the outer edge of the opposite region of the impregnation member 120 becomes, the higher the possibility that the above-mentioned "re-impregnation" may occur becomes. From such a viewpoint, unevenness (roughness) and/or a level difference, etc. may be formed in the interface between the projected part of the exudation prevention member 200 and the impregnation member 120 to fit with each other. Furthermore, what is called a "bead" may be formed in the interface between the projected part of the exudation prevention member 200 and the impregnation member 120 to make it difficult for the fuel to pass through the interface. In addition, what is called a "liquid reservoir" (concave part) is formed in the interface between the projected part of the exudation prevention member 200 and the impregnation member 120 to contain (house) the fuel passing through the interface therein.

By the way, in the conventional burner which does not comprise the exudation prevention member, it is difficult to make fuel spread evenly over the whole impregnation member while reducing the passing-through (exuding-out) of the fuel as compared with the first burner 100. Therefore, in the conventional burner, the fuel impregnated inside the impregnation member tends to be distributed unevenly in a lower part in the vertical direction of the impregnation member by action of the gravity. In this case, from a viewpoint of improving ignitability of fuel, it is desirable to arrange one igniting device in the vicinity of the lower part in the vertical direction of the impregnation member. Alternatively, in the conventionally burner, fuel still in its liquid state, which has passed through the impregnation member may flow down along the surface on the second end side (downstream side)

of the impregnation member to be collected at a bottom (in a lower part) of the combustion chamber. In such a case, from a viewpoint of preventing the igniting device from being wet with the fuel still in its liquid state, it is desirable to arrange the igniting device in a position other than the vicinity of the lower part in the vertical direction of the impregnation member.

Figure 9:
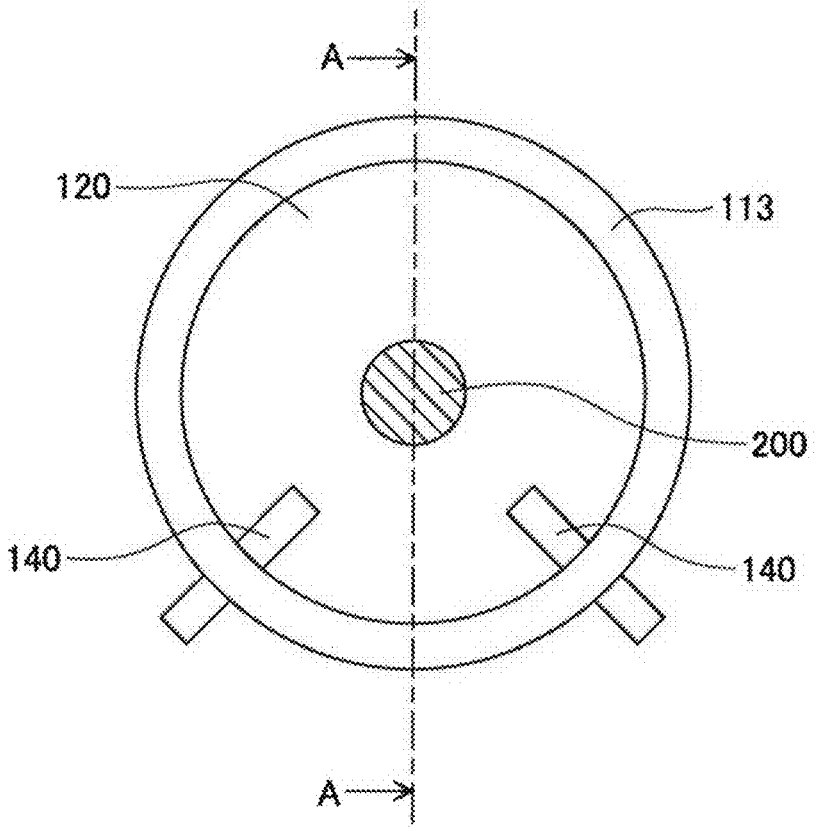
FIG. 9 is a schematic plan view for showing one modification of the first burner that comprises a plurality of igniting devices.

Similarly, although one igniting device 140 is arranged in the vicinity of a lower part in the vertical direction of the impregnation member 120 also in the example of the first burner 100 shown in FIG. 2, the number and arrangement of the igniting device 140 are not limited to the above. For example, as shown in FIG. 9, a plurality (in FIG. 9, two) of the igniting device 140 may be disposed to raise ignitability of fuel, and the igniting device 140 may be disposed in a position other than the lower part in the vertical direction of the exudation prevention member 200. Furthermore, since the first burner 100 can spread fuel evenly over the whole impregnation member 120 as mentioned above, degrees of freedom in arrangement of the igniting device 140 is higher as compared with the conventional burner. Specifically, for example, the igniting device 140 may be arranged not only in the lower part, but also in the vicinity of a lateral part and/or an upper part in the vertical direction of the impregnation member 120.

Although a case where the first burner 100 is used in a state that the axis direction of the inside housing 113 is a horizontal direction has been mentioned in the above explanation, attitude (posture) of the first burner 100 (the axis direction of the inside housing 113) in a state where the first burner 100 is being used is not limited to a horizontal direction. Namely, the first burner 100 can be used without any problem, even when the axis direction of the inside housing 113 is a horizontal direction and a vertical direction, and furthermore in a diagonal direction inclined to these directions, without any problem, and can solve the subject to be solved by the present invention can be solved successfully.

When the first burner 100 is used in a state where the axis direction of the inside housing 113 is in a direction other than the horizontal direction, the side of the impregnation member 120 in the axis direction of the inside housing 113 comes to be an "upstream side", and the opposite side comes to be a "downstream side." Moreover, in this case, the direction perpendicularly intersecting with the horizontal direction among directions perpendicularly intersecting with the axis direction of the inside housing 113 comes to be an "up-and-down direction", the side upward of the vertical direction comes to be an "upper part" and the side downward of the vertical direction comes to be a "lower part" in the "up-and-down orientation."

Second Embodiment

Hereafter, an example of a configuration of an evaporation type burner according to a second embodiment of the present invention (which may be referred to as a "second burner" hereafter) will be explained in more detail referring to drawings.

<Configuration of Burner>

Except for points which will be explained below, a fundamental configuration of the second burner is the same as that of the first burner 100 mentioned above while referring to FIG. 1. Therefore, explanation about the fundamental configuration of the second burner will be omitted here.

<Exudation Prevention Member>

As mentioned above in the explanation about the first burner 100, as for the exudation prevention member 200 which the present invention burner comprises, its entirety may be embedded inside the impregnation member, its entirety may be arranged outside the impregnation member, or a part thereof may be embedded inside the impregnation member while the other part thereof may be projected from a surface of the impregnation member.

The exudation prevention member 200 which the second burner comprises has the "projected part" which is at least a part of the exudation prevention member 200 projected from the surface of the impregnation member 120 toward the second end side, like the examples shown in FIG. 3, (*b*) of FIG. 4, (*d*) to (*f*) of FIG. 5 and FIG. 6 to FIG. 8.

<Effectiveness>

The projected part of the exudation prevention member 200 serves as an obstacle in a space where flame can spread immediately after light-up of fuel by the igniting device 140, and the flame comes to spread to vapor of the fuel supplied from the surface of the impregnation member 120 exposed to a space where the projected part does not exist. Namely, in a space on the upstream side (in the vicinity of the impregnation member 120) of the combustion chamber 110, in which light-up of the fuel by the igniting device 140 occurs, a region to which the vapor of the fuel is supplied and a region in which flame can spread are sufficiently matched with each other, due to the existence of the projected part of the exudation prevention member 200. As a result, since the flame promptly spreads after the light-up of the fuel by the igniting device 140, stabilization of combustion can be attained at an early stage.

In order to attain the above-mentioned effectiveness, it is desirable that height (dimension in the axis direction of the inside housing 113) of the projected part of the exudation prevention member 200 from the impregnation member 120 is large to a certain extent. Specifically, it is desirable that the height of the projected part is nearly equal to or more than the size (dimension in the axis direction of the inside housing 113) of the flame generated when the fuel is lit up (ignited) by the igniting device 140 and thereafter. Moreover, the size of this flame is influenced by a positional relation between the impregnation member 120 and the igniting device 140, the supply rate of fuel by the fuel supply part 130, and the supply rate of air from the air-supply hole 110*c* (and 110*d*), etc. Therefore, the specific height of the projected part can be determined by a preliminary experiment to which design specification and operating conditions of the second burner, etc. are reflected, etc., for example.

Third Embodiment

Hereafter, an example of a configuration of an evaporation type burner according to a third embodiment of the present invention (which may be referred to as a "third burner" hereafter) will be explained in more detail referring to drawings.

<Configuration of Burner>

A fundamental configuration of the third burner is the same as that of the above-mentioned first burner 100 and second burner, except that the third burner further comprises a partition member. Accordingly, a configuration of the third burner will be explained below paying attention to the partition member. Therefore, although the exudation prevention member 200 which the third burner 103 comprises is omitted also in FIG. 10, similarly to FIG. 1, the third burner 103 can comprise various exudation prevention members 200 including the exudation prevention member 200 which the above-mentioned first burner 100 and second burner may comprise, and the exudation prevention member 200 which modifications of the third burner 103 which will be mentioned later may comprise.

<Partition Member>

Figure 10:
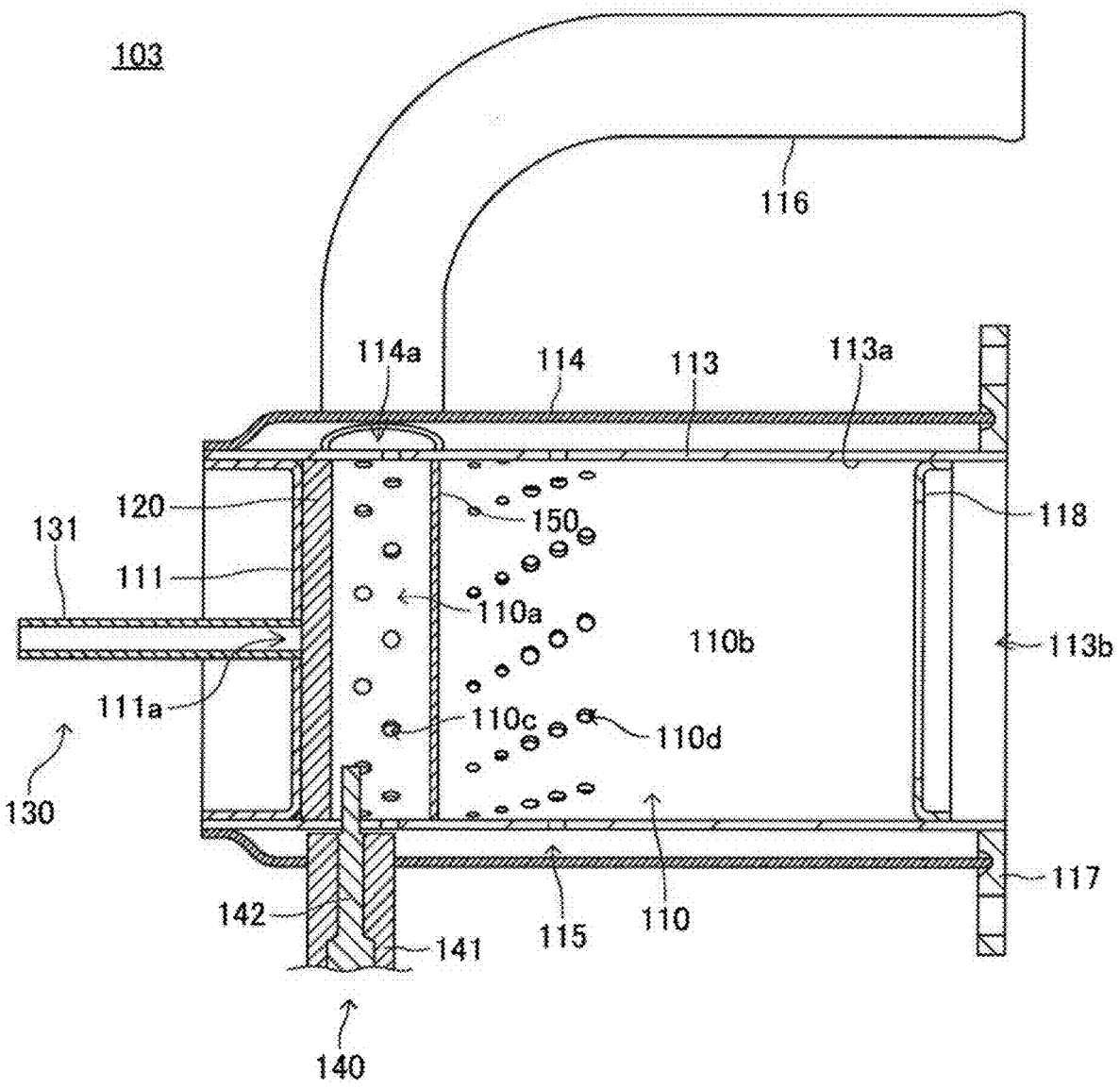
FIG. 10 is a schematic sectional view of an evaporation type burner according to a third embodiment of the present invention (third burner) taken along a plane including the axis of the inside housing.

The third burner 103 further comprises a partition member 150 disposed at a prescribed interval from the impregnation member 120 on the side nearer to a second end than the impregnation member 120 (downstream side) in the combustion chamber 110, as shown in FIG. 10. The second end is an end on an opposite side to the first end of the combustion chamber 110. And, a light-up space 110*a*, which is a space located on the first end side (upstream side) of the partition member 150 in the combustion chamber 110, and a combustion space 110*b*, which is a space located on the second end side (downstream side) of the partition member 150 in the combustion chamber 110, are in communication with each other through at least a part of a gap and/or through-hole formed in the partition member 150.

In addition, in the present invention burner which comprises the partition member 150 like the third burner 103, the air-supply hole which is opened to the light-up space 110*a* shall be referred to as a first air-supply hole 110*c*, and the air-supply hole which is opened to the combustion space 110*b* shall be referred to as a second air-supply hole 110*d*.

Figure 11:
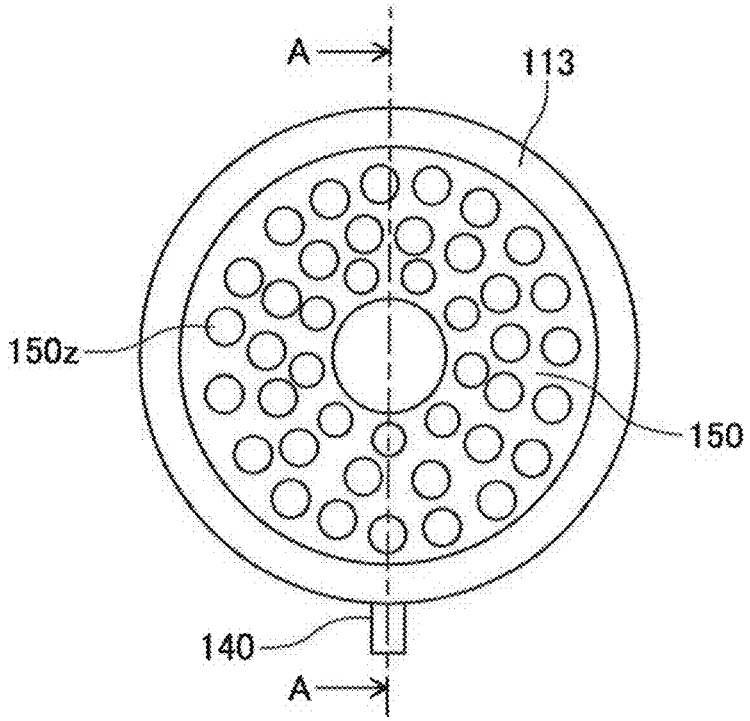
FIG. 11 is a schematic plan view when observing the third burner from the downstream side along the axis direction of the inside housing.
Figure 12:
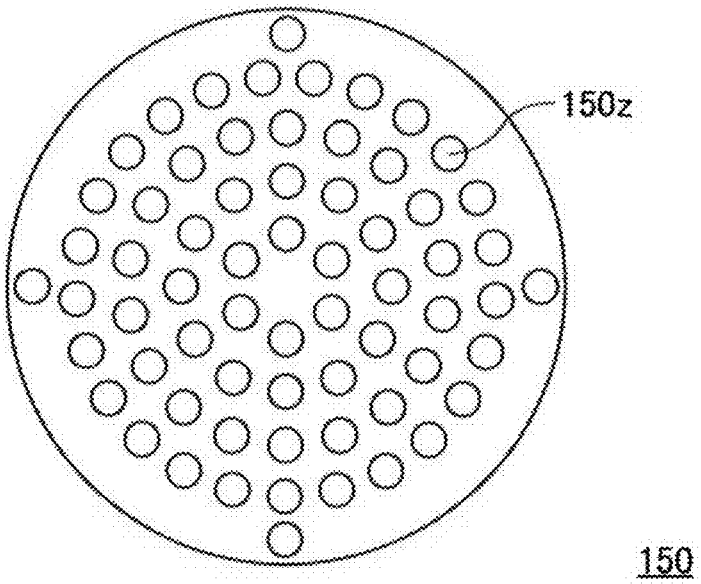
FIG. 12 is a schematic plan view for showing one modification of the partition member which the third burner comprises.
Figure 12:
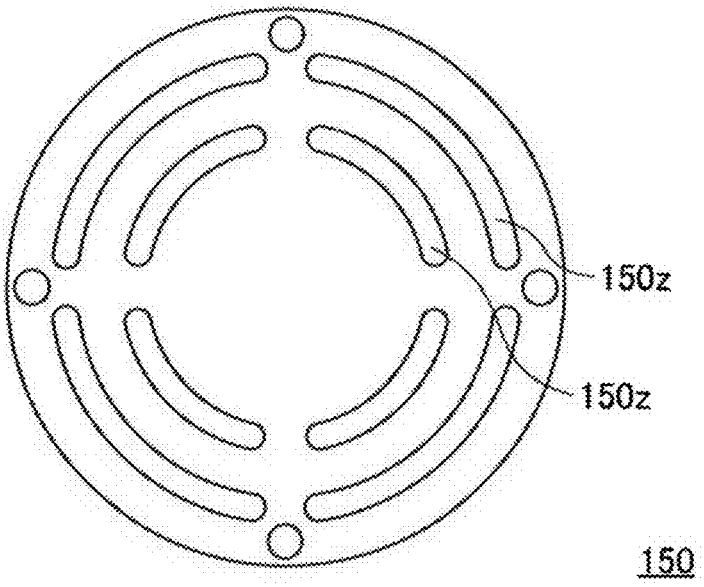

FIG. 11 is a schematic plan view when observing the third burner 103 from the second end side (downstream side) along the axis direction of the inside housing 113. The partition member 150 shown in FIG. 11 is a tabular member in which many through-holes 150*z* are formed. However, for example, as shown in FIG. 12, (a) a partition member 150 which has an array of many through-holes 150*z* and (b) a partition member 150 which has through-holes 150*z* in different shape can also be used.

Figure 13:
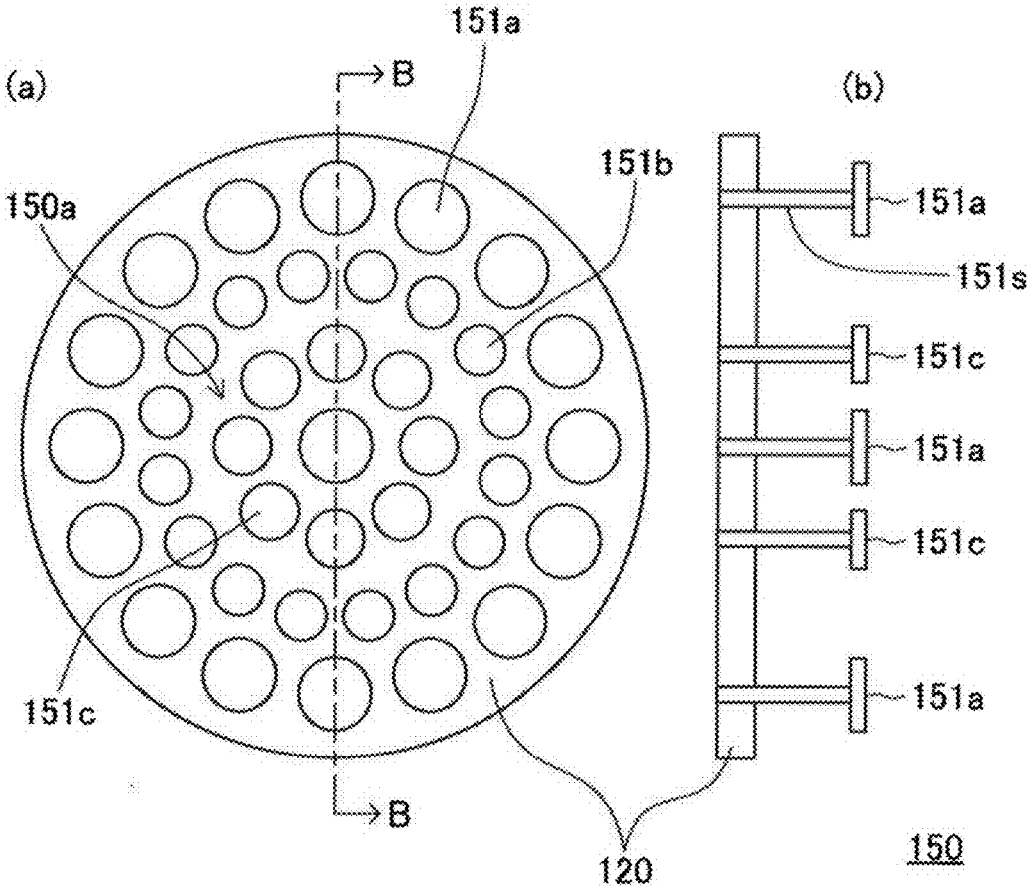
FIG. 13 is a schematic plan view for showing another modification of the partition member which the third burner comprises.
Figure 14:
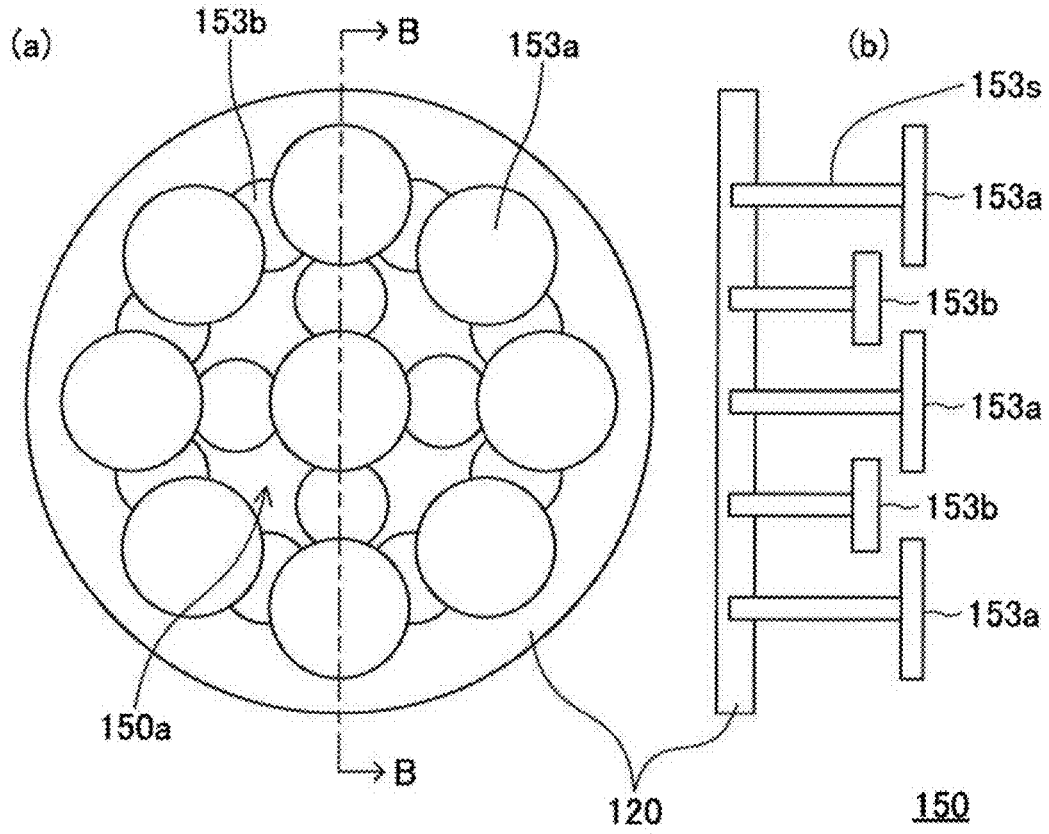
FIG. 14 is a schematic plan view for showing further another modification of the partition member which the third burner comprises.

Moreover, for example, as shown in FIG. 13 and FIG. 14, the partition member 150 may be constituted by partition elements 151*a* to 151*c* or partition elements 153*a* and 153*b*, which are a pluralities of components disposed apart from one another (with gaps among one another) in the axis direction of the inside housing 113 and/or in a direction perpendicularly intersecting with the axis direction of the inside housing 113. In this case, the light-up space 110*a* and the combustion space 110*b* are in communication with each other through a penetration region 150*a* which is a gap existing among the partition elements shown in the drawings. Namely, in this case, the penetration region 150*a* acts as the above-mentioned through-hole 150*z*.

In addition, in the partition member 150 shown in FIG. 13 and FIG. 14, each of the partition elements 151*a* to 151*c* and each of the partition elements 153*a* and 153*b* comprise a supporting part 151*s* and a supporting part 153*s* which are parts having a pillar shape extending in the axis direction of the inside housing 113, and each of the partition elements 151*a* to 151*c* and each of the partition elements 153*a* and 153*b* are supported by the supporting parts 151*s* and the supporting parts 153*s* being inserted in the impregnation member 120. However, a specific method for supporting each of the partition elements 151*a* to 151*c* and each of the partition elements 153*a* and 153*b* is not limited to the above.

Figure 15:
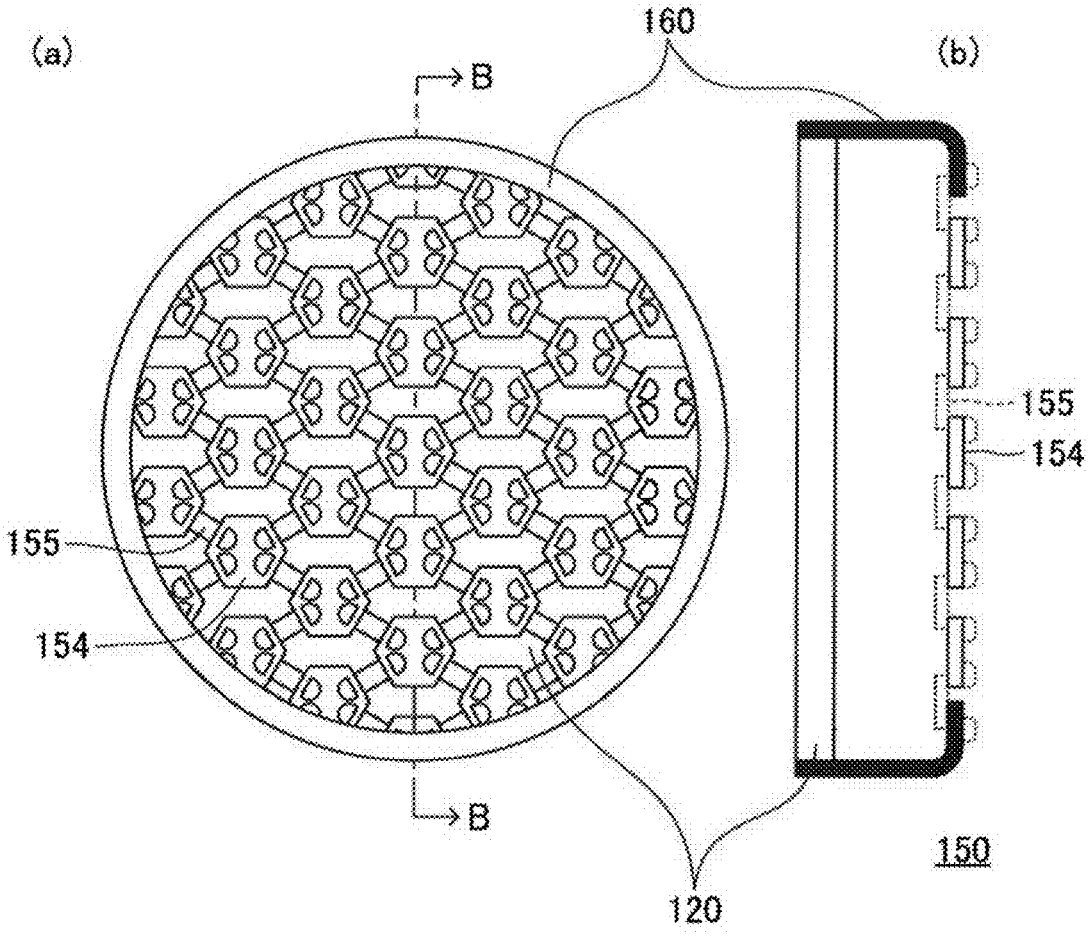
FIG. 15 is a schematic plan view for showing further another modification of the partition member which the third burner comprises.

Furthermore, for example, as shown in FIG. 15, the partition member 150 may be constituted by engaging adjacent partition elements 154 with each other through a connecting member 155. In addition, the partition member 150 may have a combination of various configurations including these. Namely, a specific configuration of the partition member 150 is not limited in particular as long as the above-mentioned requirements are satisfied, and can be suitably chosen from various configurations according to design specification and operating conditions of the third burner 103, etc., for example.

<Effectiveness>

In the third burner 103 which has the configuration as mentioned above, when the impregnation member 120 and the partition member 150 are observed from the downstream side, a principal surface on the downstream side of the impregnation member 120 is at least partially covered with the partition member 150, and exposed area of the impregnation member 120 is reduced. As a result, for example, a possibility that combustion gas may flow backward to the vicinity of the impregnation member 120 in the combustion chamber 110 due to pressure fluctuation of exhaust in association with power variation of an internal combustion engine, etc., and problems such as a misfire and/or combustion failure may arise can be reduced.

Moreover, by radiant heat from the partition member 150 heated by flame at the time of combustion of fuel in the combustion chamber 110, the impregnation member 120 can be warmed effectively to promote evaporation of the fuel from the impregnation member 120 and, as a result, the ignitability of the burner can be improved.

Furthermore, fuel-air mixture of vapor of the fuel which evaporates from the impregnation member 120 and air supplied into the light-up space 110*a* through the first air-supply hole 110*c* can flow from the light-up space 110*a* into the combustion space 110*b* through the partition member 150. At this time, by the above-mentioned fuel-air mixture passing through the gap and/or through-hole in the partition member 150, concentration of the fuel in the above-mentioned fuel-air mixture can be equalized.

<Modification of Third Burner>

Figure 16:
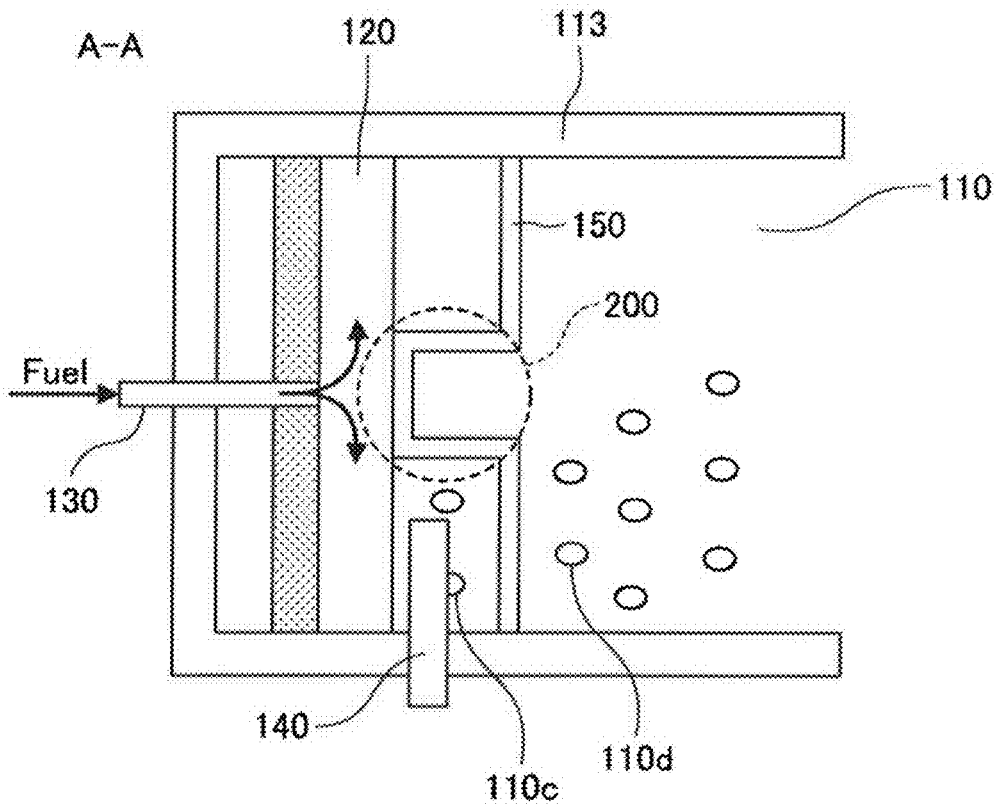
FIG. 16 is a schematic sectional view of one modification of the third burner in which the exudation prevention member is constituted as a part of the partition member, taken along a plane including the axis of the inside housing.

In the third burner 103, the exudation prevention member 200 may be constituted as a part of the partition member 150. For example, as shown in FIG. 16, a part formed by bending a part (central part) of the partition member 150 so as to become convex toward the upstream side (first end side) may be used as the exudation prevention member 200 (refer to a region surrounded by a broken line in the drawing), and this may be made to contact with the impregnation member 120.

Figure 17:
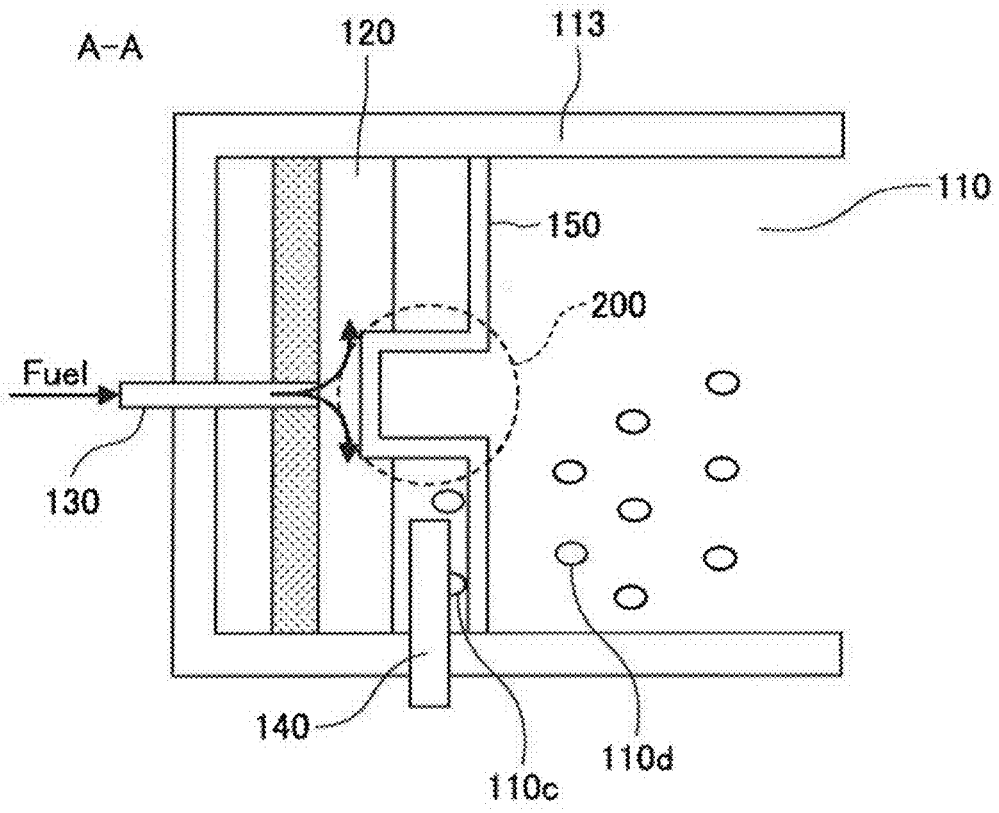
FIG. 17 is a schematic sectional view of one modification of the third burner in which the exudation prevention member is constituted as a part of the partition member and partially embedded in the impregnation member, taken along a plane including the axis of the inside housing.
Figure 18:
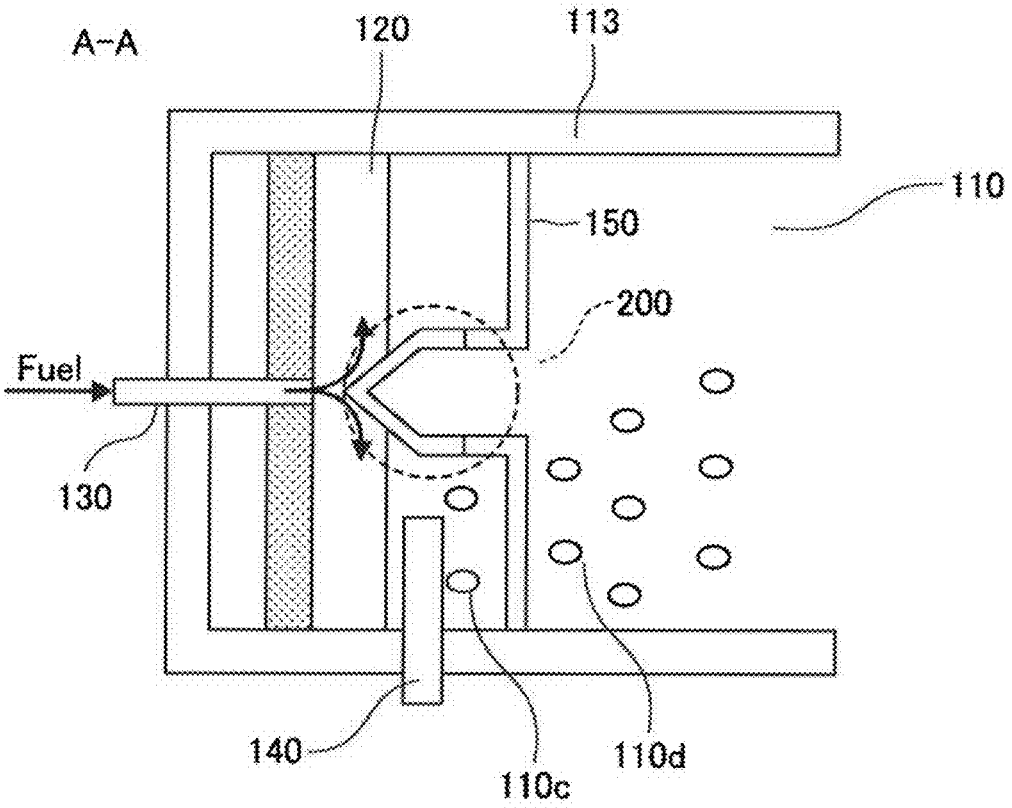
FIG. 18 is a schematic sectional view of another modification of the third burner in which the exudation prevention member is constituted as a part of the partition member and partially embedded in the impregnation member, taken along a plane including the axis of the inside housing.
Figure 19:
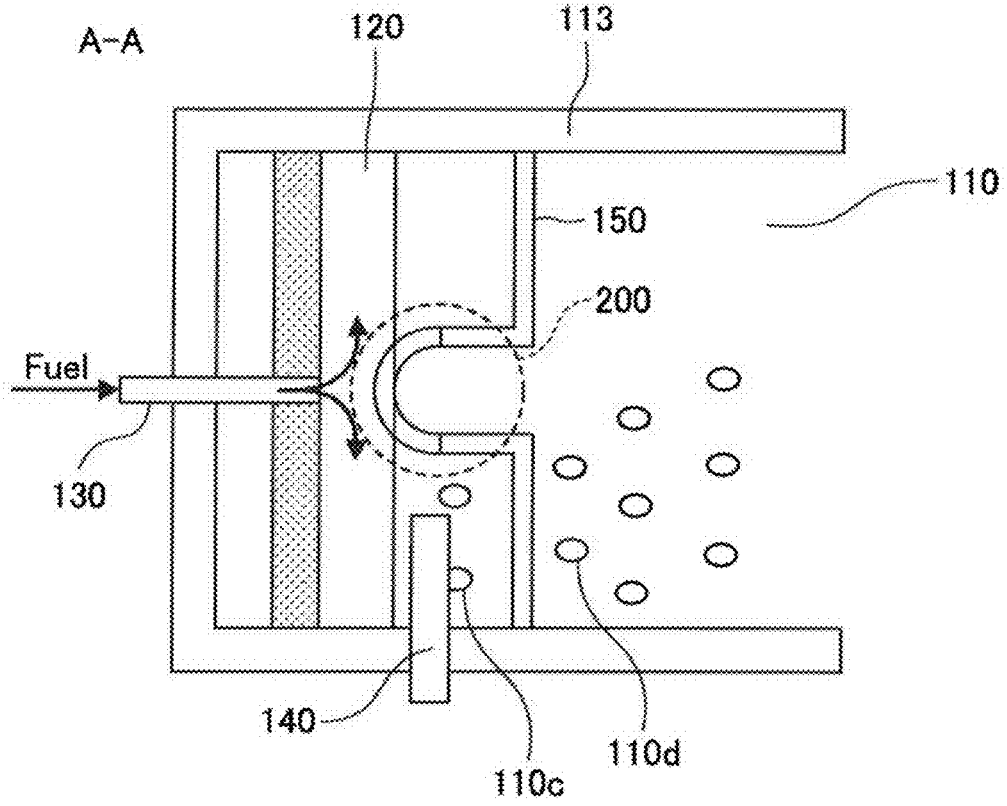
FIG. 19 is a schematic sectional view of further another modification of the third burner in which the exudation prevention member is constituted as a part of the partition member and partially embedded in the impregnation member, taken along a plane including the axis of the inside housing.

Alternatively, as shown in FIG. 17 to FIG. 19, a part formed by bending a part (central part) of the partition member 150 so as to become convex toward the upstream side (first end side) may be used as the exudation prevention member 200 (refer to a region surrounded by a broken line in the drawing), and a part of this may be embedded in the impregnation member 120. Also in this case, the cross sectional shape of the embedded part of the exudation prevention member 200 may be a rectangle (FIG. 17), a triangle (FIG. 18), a half circle (FIG. 19), or other shapes.

In accordance with the above, since the exudation prevention member 200 and the partition member 150 can be manufactured integrally, a number of parts and assembly man hour for the third burner 103 can be reduced, and it leads to reduction of a manufacturing cost as a result. Moreover, since the impregnation member 120 can be warmed effectively to promote the evaporation of the fuel from the impregnation member 120 also by heat conduction, in addition to the radiant heat from the partition member 150 heated by flame at the time of combustion of fuel in the combustion chamber 110, the ignitability of the third burner 103 can be improved as a result.

By the way, also when the exudation prevention member 200 is constituted as a part of the partition member 150 as mentioned above, the exudation prevention member 200 and the impregnation member 120 are connected with each other by a method, such as sintering, for example. Namely, in this case, the partition member 150 and the impregnation member 120 are connected through the exudation prevention member 200 which is a part of the partition member 150.

Figure 20:
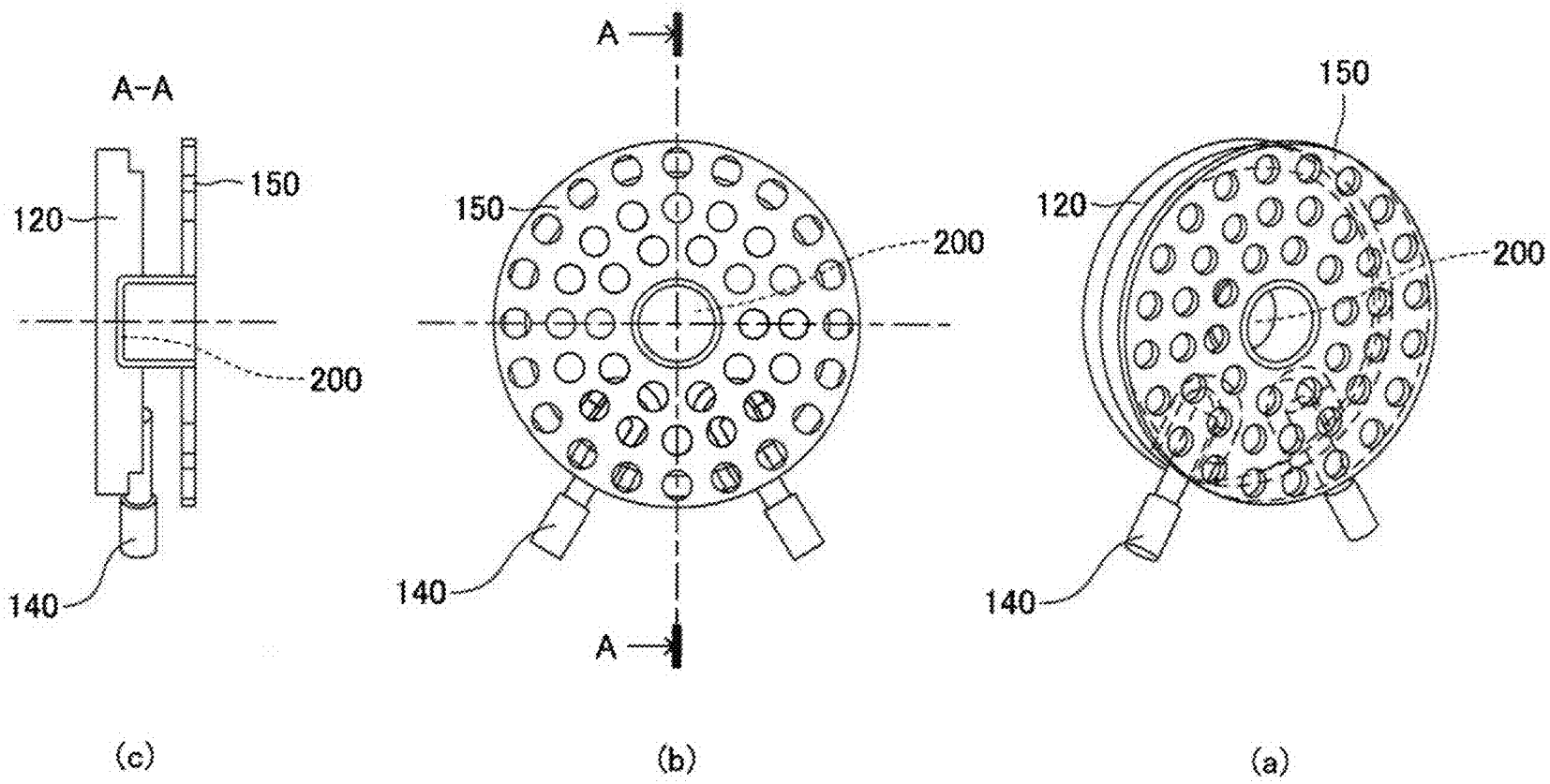
FIG. 20 is (a) a schematic perspective view, (b) a schematic plan view when observing from the downstream side along the axis direction of the inside housing, and (c) a schematic sectional view taken along a plane including the line A-A shown in the above (b), of one modification of the third burner in which the partition member and the impregnation member are connected with each other through the exudation prevention member constituted as a part of the partition member.
Figure 21:
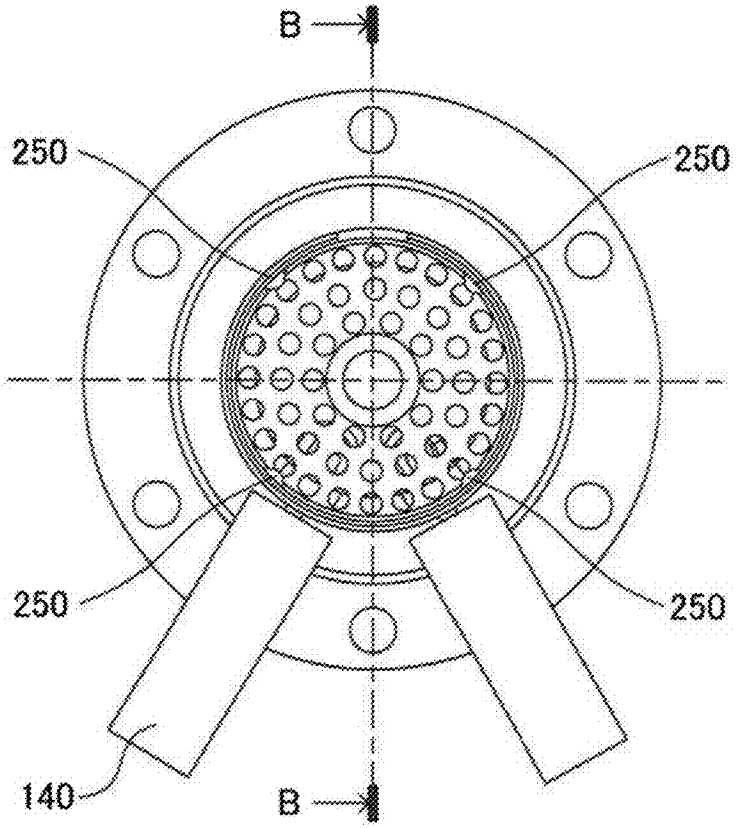
FIG. 21 is (a) a schematic plan view when observing from the downstream side along the axis direction of the inside housing and (b) a schematic sectional view taken along a plane including the line B-B shown in the above (a), of the third burner in which the partition member and the impregnation member connected with each other through the exudation prevention member shown in FIG. 20.
Figure 21:
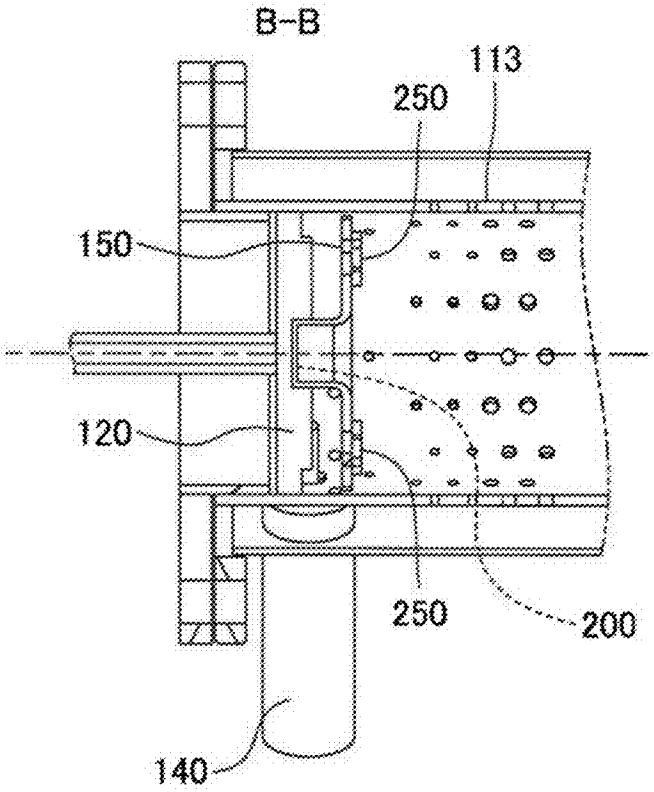

In the above-mentioned case, the partition member 150 is supported by the impregnation member 120 through the exudation prevention member 200 which is a part of the partition member 150, as shown in FIG. 20, for example. Therefore, the partition member 150 does not need to be connected with the inside housing 113. For example, as shown in FIG. 21, the partition member 150 may be supported by the impregnation member 120 through the exudation prevention member 200, and may be positioned in the axis direction of the inside housing 113 by forming stoppers 250 at predetermined points on the inner wall of the inside housing 113 and bringing a peripheral part of the partition member 150 to contact with these stoppers 250. As the stopper 250, for example, "cut and raised part", which is a part formed by slitting the inner wall of the inside housing 113 and making the slit portion project inward, can be mentioned, for example. However, a separate member may be fixed at the predetermined points on the inner wall of the inside housing 113 in place of the cut and raised part. Thereby, the number of parts and assembly man hour for the third burner 103 can be reduced, and it leads to reduction of the manufacturing cost as a result.

Although a concave part is formed in the impregnation member 120 and a part of the igniting device 140 is arranged inside the concave part in FIG. 20 and FIG. 21, such an arrangement is not an essential constituent element of the present invention, the igniting device 140 may be arranged at a position apart to the second end side (downstream side) of the impregnation member 120, like the configuration shown in FIG. 1, FIG. 3, FIG. 4, FIG. 6 to FIG. 10 and FIG. 16 to FIG. 19, for example.

Figure 22:
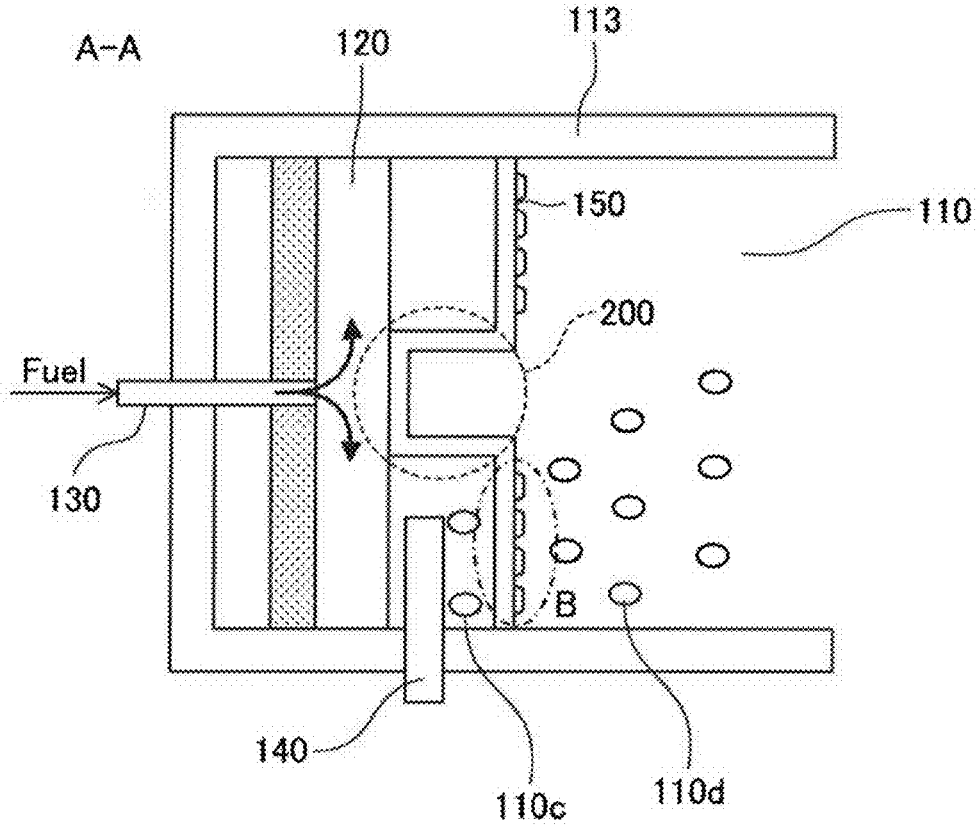
FIG. 22 is a schematic sectional view and partially enlarged view for showing one modification of a configuration of the partition member which the third burner comprises.
Figure 22:
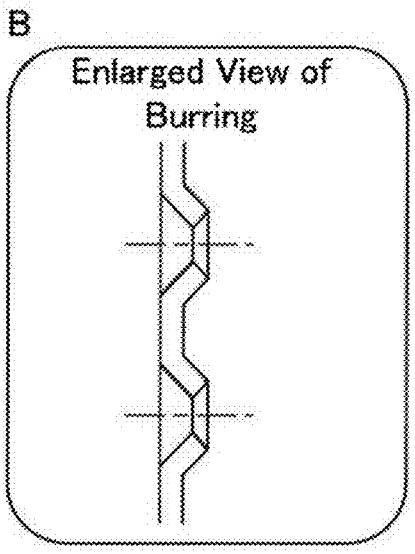

By the way, when adopting a tabular partition member, it may become difficult to maintain rigidity as the whole partition member, depending on thickness and area, etc. of plate material (board) constituting the partition member, for example. In such a case, what is called "burring" can be mentioned as a strategy for enhancing the rigidity of the partition member. For example, as shown in FIG. 22, the rigidity of the partition member can be enhanced without taking steps such as thickening of the partition member, etc., by performing a burring processing to bend and raise a peripheral part of the through-hole 150*z* of the partition member 150 (refer to a region surrounded by a the dash-dot line and its enlarged view B).

Fourth Embodiment

Hereafter, an example of a configuration of an evaporation type burner according to a fourth embodiment of the present invention (which may be referred to as a "fourth burner" hereafter) will be explained in more detail referring to drawings.

For example, in the first burner 100 shown in FIG. 1, the first air-supply holes 110*c* are formed all over the circumference of the inside housing 113. Also in such a configuration, fuel can be lit up and burned without particular problems, for example, in a case where air supply rate to the burner is relatively low and in a case where the diameter of the inside housing 113 is large, etc.

However, for example, in a case where air supply rate to the burner is relatively high and in a case where the diameter of the inside housing 113 is small, etc., flame generated by the fuel lit up by the igniting device 140 may be blown out by a flow of air which blows from an upper side of the inside housing 113.

<Configuration of Burner>

Accordingly, in the fourth burner, the axis direction of said inside housing is a horizontal direction, and no air-supply hole 110*c* is formed on an upper side in a vertical direction than a tip of the igniting device 140 in the combustion chamber 110, at least at a position, which is first distance away to the second end side (downstream side) from the impregnation member 120 in the axis direction of the inside housing 113, on the peripheral wall of the inside housing 113. The first distance is distance between the impregnation member 120 and an air-supply hole 110*c* nearest to the impregnation member 120 in the axis direction of the inside housing 113 among the plurality of the first air-supply holes 110*c* and the second air-supply holes 110*d*.

More preferably, in the fourth burner, no air-supply hole 110*c* is formed on the upper side in the vertical direction than a center of the combustion chamber 110, at least at a position, which is the first distance away to the second end side (downstream side) from the impregnation member 120 in the axis direction of the inside housing 113, on the peripheral wall of the inside housing 113.

In other words, in the fourth burner, the air-supply hole 110*c* nearest to the impregnation member 120 is formed only in a region lower than the tip of the igniting device 140 or the center of the combustion chamber 110 (region on the lower side in the vertical direction), in a state where the axis direction of the inside housing 113 is a horizontal direction. Such configurations are shown in FIG. 16 to FIG. 19, FIG. 21 and FIG. 22, for example.

<Effectiveness>

In accordance with the above, for example, even in a case where air supply rate to the burner is relatively high and in a case where the diameter of the inside housing 113 is small, etc., the possibility that flame generated by the fuel lit up by the igniting device 140 may be blown out by a flow of air which blows from the upper side of the inside housing 113 is reduced. Moreover, an advantageous effect that flame becomes more stable is also attained by air being supplied from the lower side.

Moreover, when the exudation prevention member 200 has the projected part which is projected from the surface of the impregnation member 120 toward the second end side (downstream side) as mentioned above, an advantageous effect that an air flow swirling around the projected part as a center in the vicinity of the exudation prevention member 120 is produced and propagation of the flame after light-up (ignition) is promoted is also attained by limiting the air-supply holes in the vicinity of the igniting device 140 to the lower side as mentioned above.

Although some the embodiments and modifications having specific configurations have been explained sometimes referring to the accompanying drawings as mentioned above, for the purpose of explaining the present invention, it should not be interpreted that the scope of the present invention is limited to these exemplary embodiments and modifications, and it is needless to say that any correction can be suitably added within the limits of the matters described in the claims and the specification.

REFERENCE SIGNS LIST

100: Evaporation Type Burner, 110: Combustion Chamber, 110*a*: Light-up Space, 110*b*: Combustion Space, 110*c* and 110*d*: Air-supply Hole, 111: Bottom Wall of Inside Housing, 111*a*: Through-hole of Bottom Wall, 113: Inside Housing, 113*a*: Peripheral Wall of Inside Housing, 113*b*: Opening, 114: Outside Housing, 114*a*: Air Inlet, 115: Air-supply path, 116: Air-supply Pipe, 117: Mounting Member, 120: Impregnation Member, 130: Fuel Supply Part, 131: Fuel Supply Pipe, 140: Igniting Device, 141: Igniting Device Mounting Member, 142: Igniting Means, 150: Partition Member, 150*a*: Penetration Region, 150*z*: Through-hole, 151*a*, 151*b*, 151*c*, 153*a* and 153*b*: Partition Element, 151*s* and 153*s*: Supporting Part, 154: Partition Element, 155: Connecting Member, 160: Frame, 200: Exudation Prevention Member and 250: Stopper.

The invention claimed is:

1. An evaporation type burner comprising, a combustion chamber which is a space defined by an inside housing that is a bottomed cylindrical container consisting of a bottom wall and a peripheral wall, an impregnation member which is a member disposed at a first end that is an end on said bottom wall side of said inside housing in said combustion chamber and has capillary structure and/or porous structure, a fuel supply part which supplies fuel to said impregnation member to impregnate said fuel into said impregnation member, and an igniting device which heats vapor of said fuel evaporating from said impregnation member to light up said vapor; and a plurality of air-supply holes which is opened to said combustion chamber and supplies air to said combustion chamber is formed in said peripheral wall of said inside housing, wherein:

said evaporation type burner further comprises an exudation prevention member which is a member having lower fuel permeability that is a characteristic value corresponding to permeability of said fuel than that of said impregnation member at least in an opposite region which is a surface region of said impregnation member opposite to an infiltration region which is a surface region of said impregnation member where said fuel infiltrates into said impregnation member across said impregnation member, a part of said exudation prevention member is embedded inside of said impregnation member while the other part of said exudation prevention member is projected from a surface of said impregnation member, the part of said exudation prevention member, which is embedded inside of said impregnation member, is included in the part of said exudation prevention member, which is projected from the surface of said impregnation member, in a projection onto a plane perpendicularly intersecting with an axis direction of said inside housing, and a level difference is formed at an interface between said impregnation member and the part of said exudation prevention member, which is projected from the surface of said impregnation member.

2. The evaporation type burner according to claim 1, wherein:

said exudation prevention member is an impermeable member through which the fuel cannot permeate.

3. The evaporation type burner according to claim 1, wherein:

said exudation prevention member is a member separate from said impregnation member.

4. The evaporation type burner according to claim 3, wherein:

said exudation prevention member is connected with said impregnation member by sintering.

5. The evaporation type burner according to claim 1, wherein:

the axis direction of said inside housing is a horizontal direction, and no air-supply hole is formed on an upper side in a vertical direction than a tip of said igniting device in said combustion chamber, at least at a position, which is first distance away to said second end side from said impregnation member in the axis direction of said inside housing, on said peripheral wall of said inside housing, and said first distance is distance between said impregnation member and an air-supply hole nearest to said impregnation member in the axis direction of said inside housing among the plurality of said air-supply holes.

6. The evaporation type burner according to claim 5, wherein:

no air-supply hole is formed on the upper side in the vertical direction than a center of said combustion chamber, at least at a position, which is said first distance away to said second end side from said impregnation member in the axis direction of said inside housing, on said peripheral wall of said inside housing.

7. The evaporation type burner according to claim 1, wherein:

said evaporation type burner further comprises a partition member disposed at a prescribed interval from said impregnation member on the side nearer to a second end than said impregnation member in said combustion chamber, and said second end is an end on an opposite side to said first end of said combustion chamber, and a light-up space which is a space located on said first end side of said partition member in said combustion chamber and a combustion space which is a space located on said second end side of said partition member in said combustion chamber are in communication with each other through at least a part of a gap and/or through-hole formed in said partition member.

8. The evaporation type burner according to claim 7, wherein:

said exudation prevention member is constituted as a part of said partition member.

9. The evaporation type burner according to claim 8, wherein:

said partition member is not connected with said inside housing.

* * * * *